US006143240A

United States Patent [19]

Jones et al.

[11] Patent Number: 6,143,240

[45] **Date of Patent: *Nov. 7, 2000**

[54] HIGH DENSITY FORMING PROCESS WITH POWDER BLENDS

[75] Inventors: Peter Jones, Toronto; Roger Lawcock, Burlington, both of Canada

[73] Assignee: Stackpole Limited, Mississauga, Canada

[ * ] Notice: This patent is subject to a terminal disclaimer.

[21] Appl. No.: 08/970,195

[22] Filed: Nov. 14, 1997

[51] Int. Cl.[7] ..... B22F 3/24

[52] U.S. Cl. ..... 419/25

[58] Field of Search ..... 419/38, 25

[56] References Cited

U.S. PATENT DOCUMENTS

| | | | |
|---|---|---|---|
| 5,009,704 | 4/1991 | Banik | 75/238 |
| 5,476,632 | 12/1995 | Shivanath et al. | 419/57 |
| 5,547,523 | 8/1996 | Blankenship, Jr. et al. | 148/677 |
| 5,641,922 | 6/1997 | Shivanath | 75/231 |
| 5,754,937 | 5/1998 | Jones et al. | 419/38 |

FOREIGN PATENT DOCUMENTS

| | | |
|---|---|---|
| WO 94/14557 | 7/1994 | WIPO . |
| WO 97/01651 | 1/1997 | WIPO . |
| WO 97/43458 | 11/1997 | WIPO . |
| WO 98/59083 | 12/1998 | WIPO . |

OTHER PUBLICATIONS

A. Salak: "Ferrous Powder Metallurgy" 1995, Cambridge Int. Science Publ., GB XP002095777 (pp. 287–294).

R.M. German: "Powder Metallurgy of Iron & Steel" 1998, John Willey & Sons, Inc. USA, CA XP002095778 (pp. 326–336).

*Primary Examiner*—Daniel J. Jenkins

*Attorney, Agent, or Firm*—Eugene J.A. Gierczak

[57] ABSTRACT

A method for making a high density powdered metal article is provided. In one embodiment, the composition consists of iron based powder, lubricant, graphite and ferro alloy additions. Satisfactory results may also be achieved by using fully prealloyed grades of metal powders, substantially pure powder blends, fully prealloyed powder blends, partially prealloyed powder blends and powder blends containing ferro alloys. The composition is compacted in rigid tools at ambient temperature, sintering at high temperature greater than 1100° C. and then formed in rigid tools at 40 to 90 tons per square inch to a density greater than 94% of theoretical. The high density article is then annealed. The final article demonstrates remarkable mechanical properties which are atypical of powdered metal components and approach those of wrought steel.

20 Claims, 19 Drawing Sheets

| | FeCMn 7.5 g/cc | FC0200[1] 6.9 g/cc | AISI 1020 7.8 g/cc |
|---|---|---|---|
| Tensile Strength, ksi | 60 | 34 | 62 |
| Yield Strength, ksi | 40 | 29 | 34 |
| Elastic Modulus, ksi | 25,500 | 19,000 | 29,000 |
| Elongation, % | 23 | 2 | 23 |
| Hardness, HRB | 60 | 36 | 70 |
| Impact Strength, ft lb unnotched | >120 | 6 | >120 |
| Fatigue Strength, ksi alternating stress unnotched, R=0 | 28 | 13 | 30 |
| Fatigue Ratio[2] | 0.46 | 0.38 | 0.48 |

Notes
1) MPIF Standard 35 1994 designation for a low carbon and low alloy material
2) Ratio of Fatigue Strength to Tensile Strength

FIGURE 12

HIGH DENSITY FORMING PROCESS WITH POWDER BLENDS

FIELD OF INVENTION

The invention relates to methods of forming sintered compacts of low alloy steel composition to high density at ambient temperature. The invention further relates to specific compositions of iron based powder metal sintered compacts which may be formed to high density, including the use of substantially pure powder blends, fully prealloyed powder blends, partially prealloyed powder blends and powder blends containing ferro alloys. This invention has useful application to the production of gears.

BACKGROUND OF THE INVENTION

To those appreciative of the art of manufactured PM articles, the achievement of high density is of significant importance. High density generally significantly improves the strength and durability characteristics of the manufactured article. The amount of residual porosity in relation to powder metal sintered articles of low alloy steel type compositions has a profound influence on the loading conditions that the article can withstand in its operation. At high levels of residual porosity (i.e. low density) manufactured articles are brittle and of low fatigue strength. Such low density articles can generally only be used in applications where service loading is relatively light. The available market for low density PM compacts is therefore restricted. At lower levels of residual porosity (i.e. high density), the manufactured articles become ductile and of significantly greater fatigue strength. The manufacture of low alloy PM articles at relatively high density is therefore attractive because increased market share can be achieved due to improved properties of the article.

Several prior art methods and procedures such as hot forging or double pressing and double sintering for example have been developed with the objective of increasing density for the reasons referred to above. However many of these processes have drawbacks which hinder their use for the economic production of articles in high volumes. Such drawbacks may include the requirement to use high temperatures during forming, which leads to high die wear costs, and associated dimensional accuracy problems. High cost raw materials may be used, such as fine powders. For example the metal injection molding process (MIM) uses iron of about 10 microns in size which can be used to manufacture high density articles; however the economics of the process are adversely affected because of the high cost of the raw material. Processes such as hot isostatic pressing (HIP) or pressure assisted sintering (PAS) are examples where high temperatures and high gas pressures may be used during sintering. However such equipment has throughput limitations and dimensional precision is difficult to control.

For a process to be of commercial value and offer a significant improvement in durability of the sintered powdered part the method of producing high density sintered powder metal parts should meet the following criteria:

- use low cost raw materials
- be suited to high volume production rates
- produce articles of high precision
- have acceptable tool life characteristics
- produce articles with a density in the range of 94% to 98% theoretical full density of wrought iron (equivalent to a range of 7.4 to 7.7 g/cc for low alloy compositions).

The use of a prealloyed powder is discussed by Yoshiaki et al in the SAE Technical Paper Series, given at the International Congress and Exposition in Detroit, Mich. on Feb. 27–Mar. 3, 1989, which is entitled "Improvement Of The Rolling Contact Fatigue Strength of Sintered Steel for Transmission Component". However, Yoshiaki does not teach the use of prealloyed molybdenum powder metal or ferro alloys or substantially pure blends or additional selective densification to produce powder metal parts having high density and ductility.

It is an object of this invention to provide an improved method to produce powder metal parts having high density and ductility.

It is an aspect of this invention to provide a method of forming sintered powder metal articles to a high density by forming the sintered powder metal in a closed die cavity having a clearance for movement of said sintered powder metal to final shape with increased density after compression, wherein the formed sintered powder metal part has a compressed length of approximately 3 to 30% less than the original length.

It is another aspect of this invention to produce a method of forming sintered powder metal article by blending carbon; at least one ferro alloy powder selected from the group of ferro chromium, ferro manganese, ferro molybdenum, and a lubricant, with iron powder to form a blended mixture; pressing the blended mixture to form the article; sintering the article at a temperature greater than 1250° C.; forming the sintered article in a closed die cavity having a clearance so as to produce a formed sintered powder metal part having a compressed length which is approximately 3 to 19% less than the original length when subjected to a pressure between 40 and 90 tons per square inch so as to increase the density of the formed sintered article; annealing the formed sintered article at a temperature greater than 800° C. in a reducing or carburizing atmosphere or vacuum.

It is a further aspect of this invention to provide a method of making a high density sintered powder metal article, comprising the steps of blending iron powder with ferro alloys, graphite and lubricant to provide a selected chemical composition for the finished article having at least one of the following: 0 to 0.5% carbon, 0 to 1.5% manganese, 0 to 1.5% molybdenum and 0 to 1.5% chromium and the remainder iron powder with unavoidable impurities; compacting the metal powder mixture in a rigid die to a density of approximately 90% of theoretical full density; sintering the compacted article at a temperature greater than 1250° C. in a reducing atmosphere or vacuum; forming the sintered article in rigid tools at pressure in the range of 40 to 90 tons per square inch to a density in excess of 94% of theoretical full density by axial compression allowing radial expansion to decrease the axial length of the sintered article by approximately 3 to 30% of the original axial length; annealing the high density article at a temperature greater than 800° C. in a reducing or carburizing atmosphere or vacuum, where the total alloy composition is between 0 to 4.0% by weight to the total weight of sintered powder metal article.

It is another aspect of this invention to provide a method of forming sintered powder metal articles by blending carbon and lubricant with a prealloyed molybdenum powder, pressing said blended mixture to form said article, sintering said article at a temperature of at least 1100° C., forming the sintered powder metal article in a closed die cavity having a clearance for movement of said sintered powder metal to final shape with increased density, after compression wherein the formed sintered powder metal article has a compressed length which is 3 to 30% less than the original length.

A further aspect of this invention relates to a method of forming sintered powder metal articles to a high density by forming the sintered powder metal in a die cavity having a clearance for movement of said sintered powder metal to final shape with increased density after compaction wherein the formed sintered powder metal article has a compressed length which is approximately 3 to 30% less than the original length.

Yet another aspect of this invention relates to a formed sintered powder metal article having up to 0.5% by weight Carbon, up to 1.5% by weight Mn with the remainder being iron and unavoidable impurities and having approximately 23% elongation and density greater than 7.4 g/cc.

Another aspect of this invention relates to a method of forming sintered powder metal articles to high density by selecting a target critical diameter to achieve through hardening upon quenching of the formed sintered part, then selecting a powder composition to achieve the selected target critical diameter and density between 7.4 and 7.7 g/cc.

DRAWINGS

These and other objects and features of this invention shall now be described in relation to the following drawings:

FIG. 12 is a high density forming property comparison.

SUMMARY OF THE INVENTION

Figure 1:
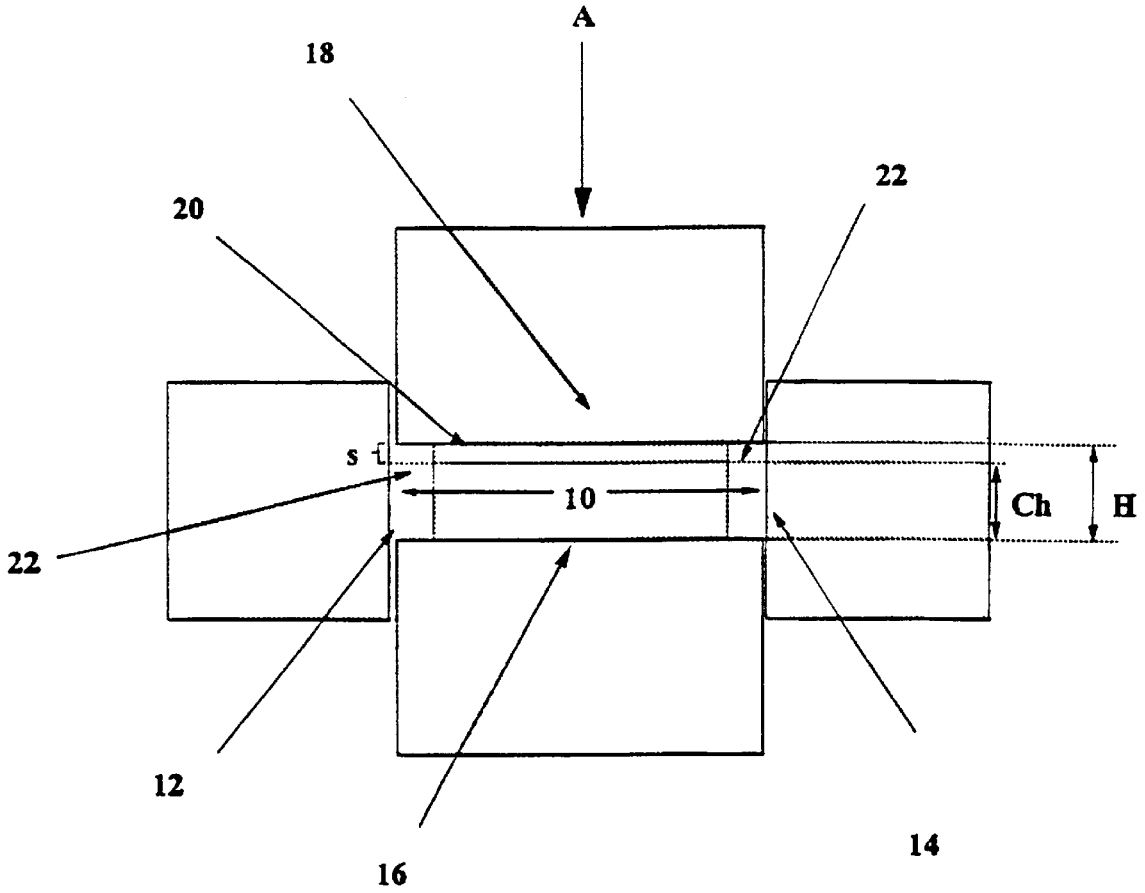
FIG. 1 is a cross sectional view of the forming process.

The present invention describes a method of forming sintered powder metal compacts to a density in the range of 7.4 to 7.7 g/cc. The compositions of the final articles are of a low alloy steel distinction where the carbon content is less than 0.5% and preferably less than 0.3% by weight of the sintered article and have formable characteristics. The forming is preferably carried out at ambient temperatures (although elevated temperatures could be used) which provides acceptable tooling life and excellent precision features.

In one embodiment the process utilizes low cost iron powders which are blended with calculated amounts of ferro alloys, graphite and lubricant such that the final desired chemical composition is achieved and the powder blend is suited to compaction in rigid compaction dies. The process is generally described in U.S. Pat. No. 5,476,632.

Alternatively it has been found that the benefits of the invention to be described herein may be arrived at by using prealloyed molybdenum powder metals in which case such materials can be sintered at conventional sintering temperatures of 1100° C. to 1150° C., or alternatively at high temperature sintering at greater than 1250° C.

As a further alternative the benefits of the invention to be described herein may be arrived at by using elemental or substantially pure iron powder blends, fully prealloyed powder blends, partially prealloyed powder blends, as well as the powder blends containing ferro alloys.

Compaction may be performed in the regular manner whereby the blended powder will be pressed into a compact to around 90% of theoretical density.

Sintering of the ferro alloy compositions is undertaken at high temperatures generally greater than 1250° C. such that oxides contained within the compact are reduced. No significant densification occurs during the sintering process. The density of the sintered compact will still be around 90% of theoretical.

Forming as defined herein includes:

(a) sizing—which may be defined as a final pressing of a sintered compact to secure a desired size or dimension;

(b) coining—which can be defined as pressing a sintered compact to obtain a definite surface configuration;

(c) repressing—which can be defined as the application of pressure to a previously pressed and sintered compact, usually for the purpose of improving physical or mechanical properties and dimensional characteristics;

(d) restriking—additional compacting of a sintered compact.

Forming to high density is carried out in regular rigid dies using conventional repressing/sizing/coining/restriking/stamping presses. Forming to high density is accomplished by the selection of the composition of the sintered compact, by the selection of pressure used in the forming operation, and by the selection of the forming tool so as to provide clearance in the tools for movement of the sintered compact to final shape. After the forming operation the article will have a density in the range of 94% to 98% of the theoretical. The actual final density may be precisely controlled by controlling the composition of the sintered article and by controlling the forming pressure.

Subsequent to the forming step, in order to fully develop the desirable mechanical properties, the article is annealed, at elevated temperature, and in a suitable atmosphere, in order to form metallurgical bonding throughout the formed article. Annealing conditions used, such as, atmosphere, temperature, time and cooling rate can be selected and varied to suit the specific final function of the manufactured article.

Detailed Description Of The Invention

A method of making a sintered powdered metal article having high density and ductility with improved mechanical properties is herein described. The present invention employs low carbon steel compositions that, after sintering, may be formed to high density at ambient temperature. The carbon utilized herein has a composition of less than 0.5% and preferably less than 0.3% by weight of the final sintered article.

The compositions of the powdered metal articles that are the subject of one embodiment of this invention are of the kind not generally employed in the powdered metal industry. Prior art compositions generally included the use of alloys consisting of iron, carbon, copper, nickel and molybdenum. In one embodiment of this invention, alloys of iron, such as manganese, chromium and molybdenum are used and are added as ferro alloys to the base iron powder as described in U.S. Pat. No. 5,476,632, which is incorporated hereby by reference. Carbon may also be added. The alloying elements ferro manganese, ferro chromium, and ferro molybdenum may be used individually with the base iron powder, or in any combination, such as may be required to achieve the desired functional requirements of the manufactured article. In other words two ferro alloys can be used or three ferro alloys can be blended with the base iron powder. Examples of such base iron powder includes Hoeganaes Ancorsteel 1000/1000B/1000C, Quebec Metal Powder sold under the trade marks QMP Atomet 29 and Atomet 1001.

The base iron powder composition consists of commercially available substantially pure iron powder which preferably contains less than 1% by weight unavoidable impurities. Additions of alloying elements are made to achieve the desired properties of the final article. Examples of compositional ranges of alloying elements that may typically be used include at least one of the following: 0 to 0.5% carbon, 0 to 1.5% of manganese, 0 to 1.5% chromium and 0 to 1.5% of molybdenum where the % refers to the percentage weight of the alloying element to the total weight of the sintered product and the total weight of the alloying elements is between 0 to 4.0%. The alloying elements Mn, Cr, and Mo are added as ferro alloys namely FeMn, FeCr, FeMo. The particle size of the iron powder will have a distribution generally in the range of 10 to 350 $\mu$m. The particle size of the alloying additions will generally be within the range of 2 to 20 $\mu$m. To facilitate the compaction of the powder a lubricant is added to the powder blend. Such lubricants are used regularly in the powdered metal industry. Typical lubricants employed are regular commercially available grades of the type which include, zinc stearate, stearic acid or ethylene bistearamide.

Alternatively prealloyed molybdenum powder metal having molybdenum compositions of 0.5% to 1.5% with the remainder being iron and unavoidable impurities can be used. Prealloyed molybdenum powder metal is available from Hoeganaes under the designation Ancorsteel 85HP (which has approximately 0.85% Mo by weight) or Ancorsteel 150HP (which has approximately 1.50% by weight Mo) or Quebec Powder Metal under the trademarks QMP at 4401 (which has approximately 0.85% by weight Mo). The particle size of the prealloyed molybdenum powder metal is generally within the range of 45$\mu$m to 250 $\mu$m typically. The same type lubricants as referred to above may be used to facilitate compaction. Carbon may also be added between 0 to 0.5% by weight.

As a further alternative the benefits of the invention to be described herein may be arrived at by using elemental or substantially pure iron powder blends, fully prealloyed powder blends, partially prealloyed powder blends, as well as the powder blends containing ferro alloys.

The formulated blend of powder containing iron powder, carbon, ferro alloys and lubricant or prealloyed molybdenum powder metal or the other blends to be described herein will be compacted in the usual manufacturing manner by pressing in rigid dies in regular powdered metal compaction presses. Compacting pressures of around 40 tons per square inch are typically employed which will produce a green compact with a density of approximately 90% of theoretical density of wrought iron. At the compaction stage the article will be substantially formed to its final required shape. Dimensional features are not quite to final specifications because allowances are made for dimensional changes which will occur during subsequent processing.

The compacted article is then sintered at high temperature, in excess of 1250° C. while a reducing atmosphere or a vacuum is maintained around the article. In the case of the prealloyed powder metal, partially prealloyed powder metal or elemental powder blends such material can be sintered at conventional sintering temperatures of 1100° C. to 1150° C. or at the higher temperature up to 1350° C. In the sintering process, contacting particle boundaries become metallurgically joined and impart strength and ductility to the sintered article. In addition, the reducing atmosphere causes a reduction of oxides from both the iron powder and the alloying element additions. The chemical reduction process provides for clean particle surfaces which enhance the metallurgical bonding of the particles, and most importantly, allows for uniform diffusion of the alloying elements into the iron particles. The final sintered article will then contain a homogeneous or near homogeneous distribution of alloying elements throughout the microstructure. A sintering method, or choice of alloying which promotes a non homogeneous microstructure is considered to be undesirable. A non homogeneous microstructure will contain a mixture of hard and soft phases which will adversely affect the forming characteristics of the sintered article.

Generally speaking, on sintering only small dimensional changes will occur. Typically it has been found that only approximately 0.3% shrinkage occurs on linear dimensions. The precise extent of dimensional movement will depend on sintering conditions employed, such as temperature, time and atmosphere, and on the specific alloying additions that are made. The sintered article will be approximately 90% of theoretical density and will be of substantially the same shape as the final article. Additional processing allowances on dimensions are present and shall be more fully particularized herein.

The sintered article is then subject to the forming operation in which dimensions are bought essentially to final requirements. In other words, dimensional control is accomplished in the moving of the sintered part during forming. Furthermore it is during the forming operation in which high density is imparted to the article. The forming operation is often referred to as coining, sizing, repressing or restriking. In essence all processes are carried out in a similar manner. The commonality is pressing of a sintered article within a closed rigid die cavity. In the high density forming operation the sintered article is pressed within a closed die cavity.

The closed die cavity of the forming operation is shown in FIG. 1. The closed rigid die cavity 10 is defmed by spaced vertical die walls 12 and 14, lower punch or ram walls 16 and upper punch or ram 18. The sintered part is represented by 20. During the forming operation upper punch or ram 18 imparts a compressive force to sintered part 20. Alternatively the compressive force can be imparted by relative movement between lower punch or ram wall 16 and upper punch or ram wall 18. The closed die cavity is designed with a clearance 22 to permit movement of the ductile sintered material in a direction perpendicular to or normal to the compressive force as shown by arrow A. During compression the overall compressed length or height of the sintered article is reduced by the dimension S.

Conventional coining may permit reduction or movement of the sintered material in direction A by 1 to 3%. The invention described herein permits movement of the sintered material beyond 3% of the original height or length. It is possible as shall be described herein that the reduction S or percentage closure of the sintered material can reach as much as 30% reduction of dimension H. Particularly advantageous results are achieved by having a closure which represents a compressed length or height Ch, which is between 3% to 19%, less than the original uncompressed length. In other words S represents the change in the overall height H of the sintered part to that of the compressed height Ch. Moreover, the compression of the overall length or height collapses the microstructural pores in the sintered powder metal part and thereby densifies the sintered part.

Figure 2:
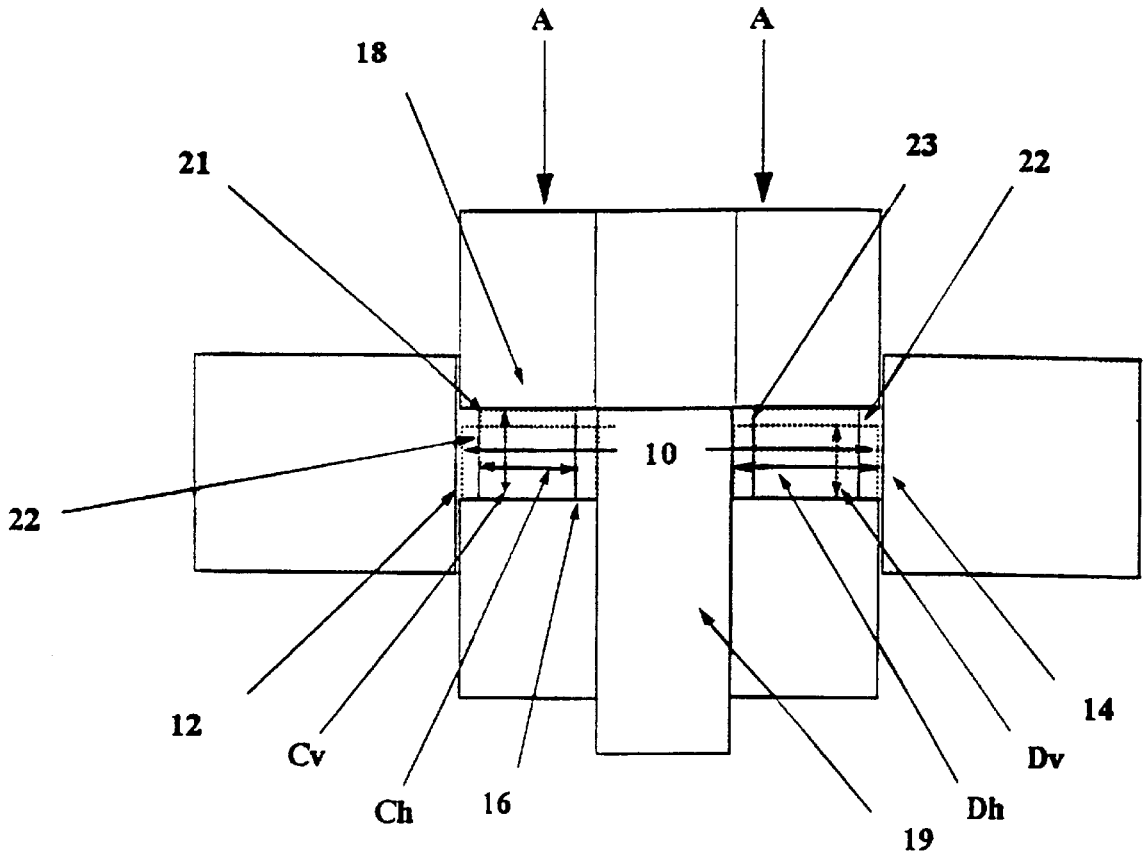
FIG. 2 is a cross sectional view of the forming process for a sintered ring.

Another example of the closed die cavity is shown in FIG. 2 where the closed rigid die cavity 10 is again defmed by the rigid tools namely spaced vertical die walls 12 and 14 respectively, the lower punch or ram wall 16 and upper punch or ram wall 18 and core 19. The core 19 moves in sliding coaxial relationship within aligned holes formed in upper punch or ram and lower punch or ram. In this case the sintered part is represented by a ring 21 which has a bore 23 therethrough. Again during the forming operation upper punch or ram 18 imparts a compressive force A to the sintered ring 21. Alternatively the compressive force can be imparted by relative movement between lower punch or ram wall 16 and upper punch or ram 18. The closed die cavity is once again designed with a clearance 22 to permit movement of ductile sintered material in a direction perpendicular or normal to the compressive force A. Once formed or compressed the sintered material will move within the closed cavity from the position of the arrows $C_V$, $C_h$ to $D_V$ and $D_h$. In other words, the sintered material will move to fill the clearance 22. Upon compression the bore 23 will have a smaller internal diameter after the application of the compressive force. The compressed height of the sintered ring 21 can be reduced by approximately 3 to 19% of the uncompressed height. In the case shown in FIG. 2, the height of the ring also represents the height is in the axial direction of the ring. In other words the sintered article is formed by axial compression allowing radial expansion to decrease the axial length of the sintered article by approximately 3 to 30% of the original axial length.

The tool clearance 22 depends on the geometry of the sintered part, and it is possible that one could have a different tool clearance 22 on the outside diameter of the part than the tool clearance on the inside diameter.

Figure 14:
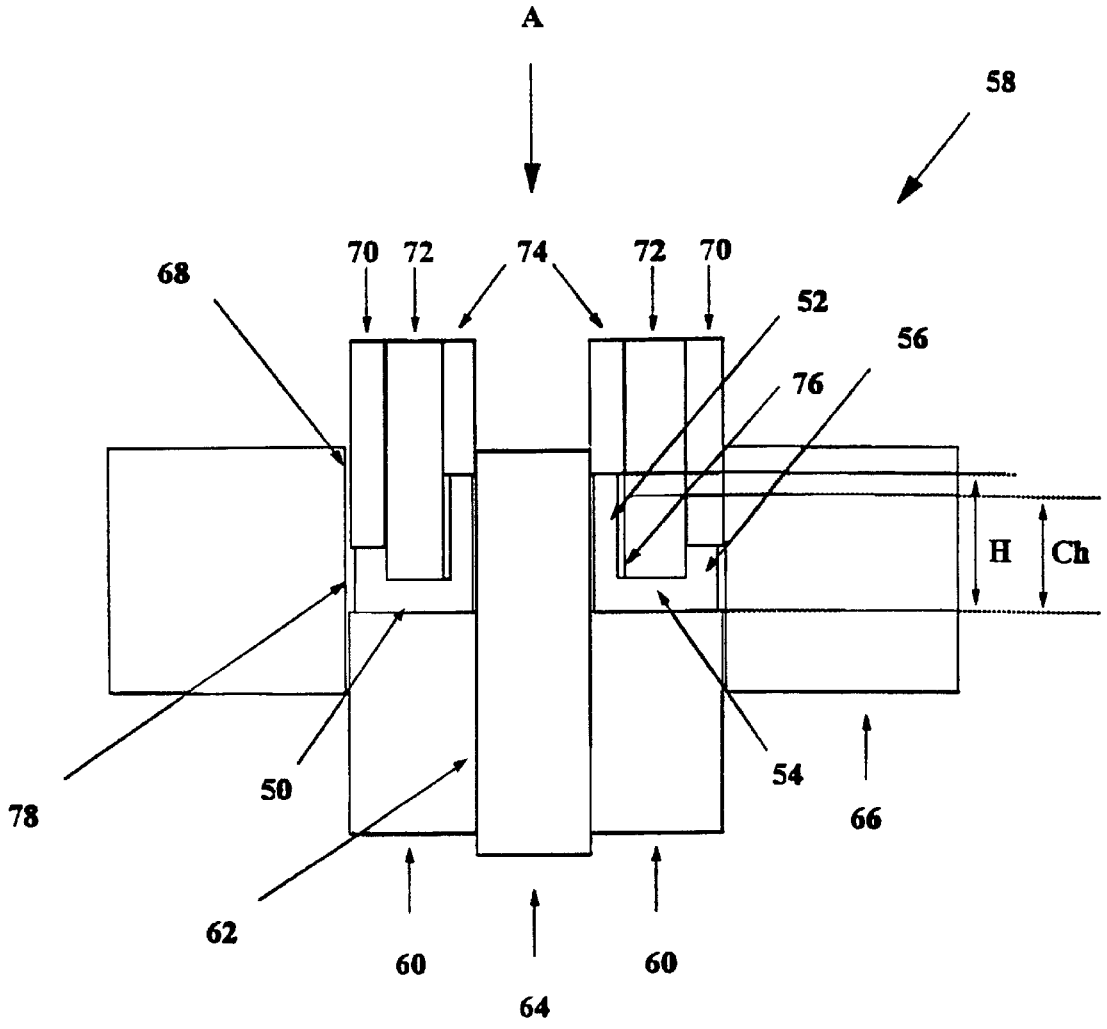
FIG. 14 is a cross sectional view of the forming process for a multi-level component.

The invention described herein may be used to produce a variety of sintered powder metal powder articles or parts which have multi-levels. FIG. 14 is a cross sectional view of the forming process for a multi-level component such as for example a transmission sprocket 50. The transmission sprocket 50 shown in FIG. 14 is cylindrical in shape with FIG. 14 being a cross sectional therethrough. The sprocket has a hub portion 52, a disc shaped portion 54 and tooth portion 56.

A multi-level component is comprised of the powder metal powders referred to earlier namely:

(a) blending carbon, at least one ferro alloy selected from the group of Ferro Molybdenum, Ferro Chromium and Ferro Manganese, a lubricant with iron powder and unavoidable impurities as the remainder, or (b) in another embodiment blending Carbon and lubricant with a prealloyed molybdenum powder as referred to earlier, or (c) in yet a further embodiment blending elemental or substantially pure powder blends, fully prealloyed powder blends, partially prealloyed powder blends the blended powders referred to above are then compacted and sintered as described earlier.

Thereafter the sintered article such as the transmission sprocket 50 is placed into rigid tools 58 which are in a press (not shown). In particular, the rigid tools 58 include a lower punch or ram 60 having a hole 62 formed therethrough to slide in a close tolerance relationship with a core 64. The rigid tools 58 also include a die 66 which has formed therein a hole 68 which slides in a close tolerance relationship with the lower punch or ram 60 and the upper punches to be described herein.

Figure 4:
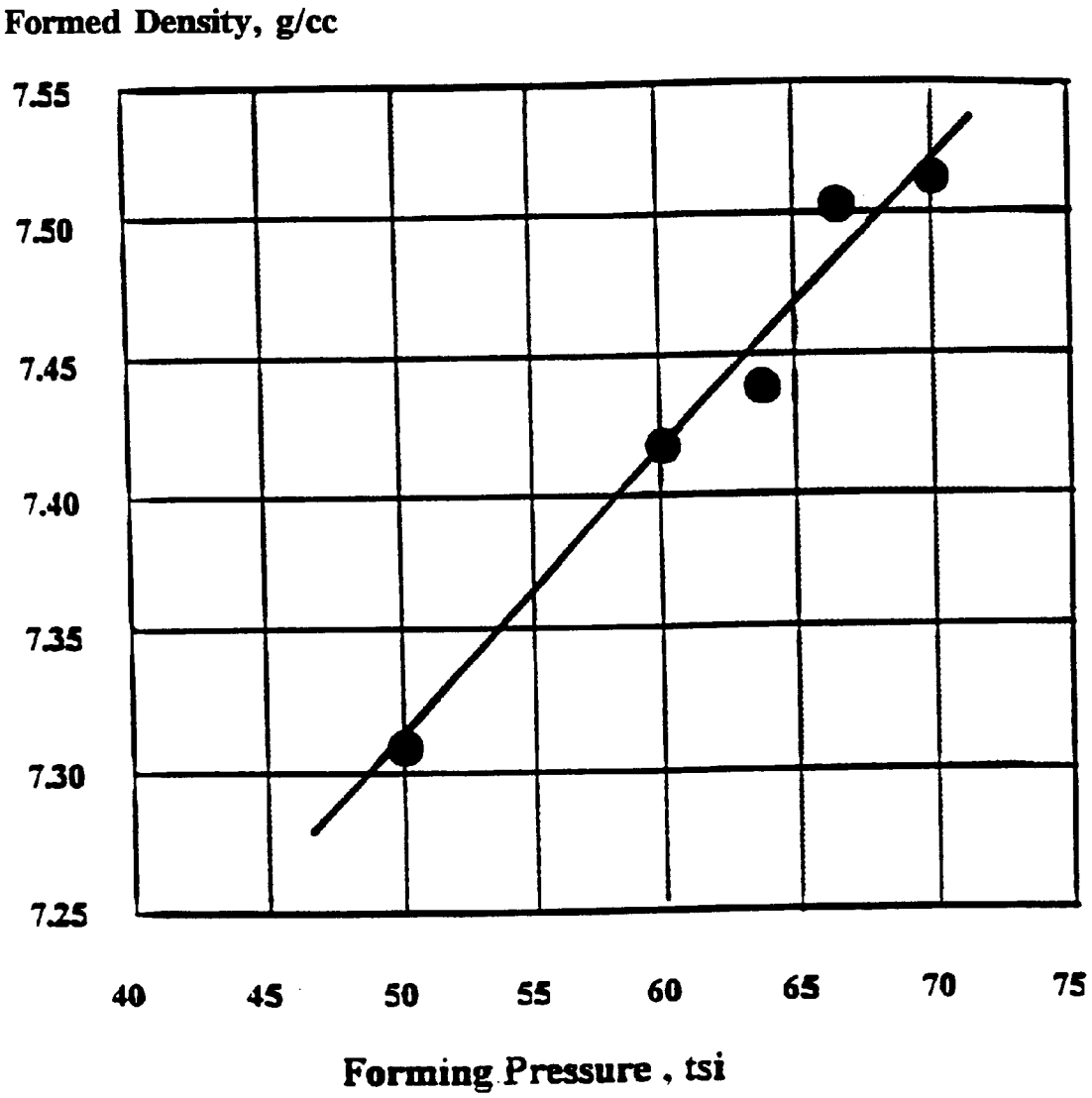
FIG. 4 is a graph of the high density forming of a clutch plate.

The upper punches may include a number of punches depending on the configuration of the multi-level part and in the example shown in FIG. 4 comprises three separate moveable punches 70, 72 and 74. The upper punches 70, 72 and 74 may comprise cylindrically shaped punches which are adapted for sliding movement relative to one another in a close tolerance relationship.

A clearance 76 is provided between the hub 52 and upper punch 72 with another clearance 78 provided between the die 66 and the tooth section 56. FIG. 14 illustrates that there is no clearance between the core 64 and the part 52 between lower punch 60 and upper punch 74; although a clearance could be provided in this area if required.

The tool set 58 shown in FIG. 14 shows the sintered multi-level part 50 in the rigid tool set 58 in a closed position. The sintered powder metal part 50 would be introduced into the tool set 58 when the upper punches 70, 72 and 74 are retracted sufficiently away from lower punch 60 and core 64 to an open position so as to permit the introduction of a multi-level sintered part 50 into the tool set 58. The die 66 could also be retracted in an upper position with the upper dies or in a lower position closer to the lower punch when the tool set 58 is in an open position. Such die 66, core 64, lower punch 60 and upper punches 70, 72, and 74 may be moved in a press (not shown) in a manner well known to those persons skilled in the art such has by utilizing cylinders, rams or punch holders.

Accordingly, once the multi-layered part 50 is introduced into the tool set 58 the lower punch 60, die 66, core 64 and upper punches 70, 72 and 74 move in relative sliding movement so as to present a closed die cavity shown in FIG. 14. The closed die cavity has clearance 76 and 78 so as to produced a formed sintered powder metal multi-level part 50 having a compressed length Ch which is approximately 3 to 30% less than the original length H so as to increase the density of said formed sintered multi-layered part 50. In the example shown in FIG. 14 the clearance 76 is located in the hub area 52 while clearance 78 is located in the tooth area 56. Accordingly the distance H or axial length of the hub 52 or the distance H of the tooth 56 will be reduced after compression between 3 to 30% in accordance with the teachings of this invention. The actual percentage shortening of the length of the hub 52 and teeth 56 in the axial direction 80 may either be the same or may be in different percentages depending on the amount of clearance 76 and 78. Moreover the thickness or axial length of the disc 54 may remain the same before forming and after forming in which event the relative movement of lower punch 60 and upper punch 72 will remain constant during forming. Alternatively, upper punch 72 and lower punch 60 may move relatively towards one another so as to permit reduction of the disc section 54 sintered material in the direction A by 1 to 3 percent as in the case of conventional forming. Reduction of 3 to 30% may also be achieved in section 54.

By utilizing a highly ductile grade of sintered powder metal, a part having a high density and high ductility is produced upon forming as described herein. During the forming step the microstructural pores collapse thereby providing a relatively higher density part. Accordingly, after heat treatment, a powder metal component providing high ductility is produced.

Particularly good results are achieved by utilizing alloying elements selected from the group of manganese, chromium, molybdenum, wherein the alloying element is in the form of a ferro alloy. In other words, the ferro alloy is selected from the group of ferro manganese, ferro chromium and ferro molybdenum. The selected ferro alloys are then blended with carbon and a lubricant with substantially pure iron powder so as to produce a sintered part having the following composition by weight to the total weight of sintered part where the total alloy content of the sintered part is between 0 to 4.0% by weight and the individual alloys have the following weight compositions:

| | |
|---|---|
| Mn | 0–1.5% |
| Cr | 0–1.5% |
| Mo | 0–1.5% |
| C | 0–0.5% |
| Fe and unavoidable impurities | remainder |

In other words the total alloy content is between 0 to 4.0% by weight and the individual alloy content of Mn, Cr, Mo are each between 0 to 1.5% with carbon between 0 to 0.5% of the total weight of the sintered part, with the remainder being substantially pure iron powder and unavoidable impurities.

The ranges referred to above include 0% weight of total alloy content so as to include the example of utilizing substantially pure iron powder with substantially no alloying additions (except unavoidable impurities) to produce a high density sintered powder metal having a density of at least 7.4 g/cc when formed in accordance with the teachings of this invention. Such part exhibits high density and good magnetic properties with high ductility.

In other examples, at least one alloying element will be selected from the group of FeMn, FeCr, FeMo, and then blended with carbon and a lubricant substantially pure iron powder so as to produce a sintered part having a total alloy composition (i.e. Mn, Cr, Mo, C) of up to 4.0% by weight of the total weight of the sintered part with the individual alloying elements having the following percent composition to total weight of the sintered part:

| | |
|---|---|
| Mn | 0–1.5% |
| Cr | 0–1.5% |
| Mo | 0–1.5% |
| C | 0–0.5% |
| Fe and unavoidable impurities | remainder |

Thereafter the sintered part is formed as described.

Example—Ferroalloy

Carbon, a ferro alloy such as ferro manganese, is blended with lubricant and iron powder. An example of iron powder used is Hoeganaes Ancorsteel 1000/1000B/1000C or QMP Atomet 29 or QMP Atomet 1001. By way of example Mn may be added as FeMn, which contains 71% Mn. The particle size of the FeMn will generally be within the range of 2 to 20 $\mu$m.

The iron powder is substantially pure iron powder with preferably less than 1% of unavoidable impurities. The particle size of the iron powder will have a distribution range of 10 to 350$\mu$m. Lubricant used may be zinc stearate. The blended mixture is compacted in a press with compacting pressure of about 40 tons per square inch to produce a green compact with a density of approximately 90% of theoretical. The compacted part is then sintered at a temperature greater than 1250° C. for a time duration of approximately 20 minutes. Sintering can occur at a temperature between 1250° C. and 1380° C. The quantity of carbon, ferro manganese and iron powder is selected so as to produce a sintered powder metal part having the following composition by weight to the weight of the total sintered part namely:

| | |
|---|---|
| C | 0.2% |
| Mn | 0.7% |
| Fe and unavoidable impurities being the remainder | |

The sintered part is then formed as previously described in a closed die cavity which defines the final net shape part. The closed die cavity will have a clearance designed for movement of the ductile sintered powder metal to collapse the pores and thereby increase the density of the formed sintered powder metal part.

Example—Prealloy

Figure 13:
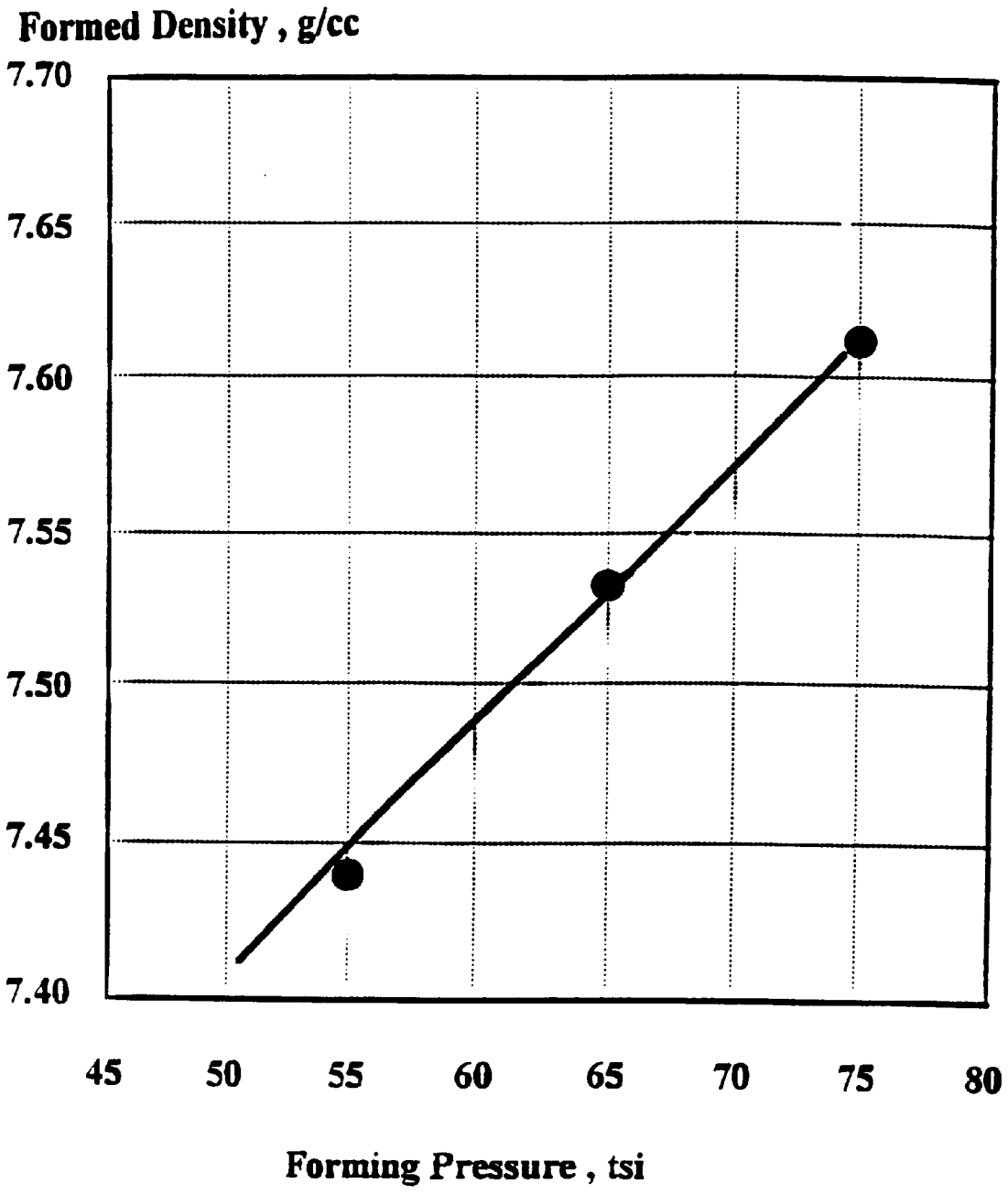
FIG. 13 is a graph of the high density forming of FeCMo Rings using a prealloyed molybdenum powder such as QMP4401 having 0.85Mo prealloy and adding 0.2% C with the remainder essentially Fe and unavoidable impurities. The graph shows the relationship of formed density to forming pressure for QMP 4401 0.85% Mo prealloy+0.2% C.

Good results have also been achieved by using prealloyed molybdenum powder having a total molybdenum content of between 0.5% to 1.5% by weight in the prealloyed form as shown in FIG. 13.

An example of prealloyed molybdenum powder which is available in the market place is sold under the designation of QMP AT 4401 which can have the following physical and chemical properties:

| | |
|---|---|
| Apparent density | 2.92 g/cm$^3$ |
| Flow | 26 seconds/50 g |
| Chemical analysis | |
| C | 0.003% |
| O | 0.08% |
| S | 0.007% |
| P | 0.01% |
| Mn | 0.15% |
| Mo | 0.85% |
| Ni | 0.07% |
| Si | 0.003% |
| Cr | 0.05% |
| Cu | 0.02% |
| Fe | greater than 98% |

Other grades such as Hoeganaes Ancorsteel 85HP (which has approximately 0.85% Mo by weight) or Ancorsteel 150HP (which has approximately 1.50% by weight of Mo) and QMP AT 4401 (which has approximately 0.85% by weight of Mo) can be used. The particle size of the prealloyed powder will generally fall within the range of 45 $\mu$m to 250 $\mu$m typically.

The prealloyed molybdenum powder is blended with lubricant and 0 to 0.5% by weight of carbon to total weight of sintered powder metal, and then compacted as described above to produce a green compact with a density of approximately 90% of theoretical density of wrought iron. The compacted article is then sintered at either conventional sintering temperatures of 1100° C. to 1150° C. or could alternatively be sintered at a higher temperature up to 1350° C. for a time duration of approximately 20 minutes.

The sintered part is then formed as previously described.

Forming

Particular examples including the forming step shall now be described.

Figure 3:
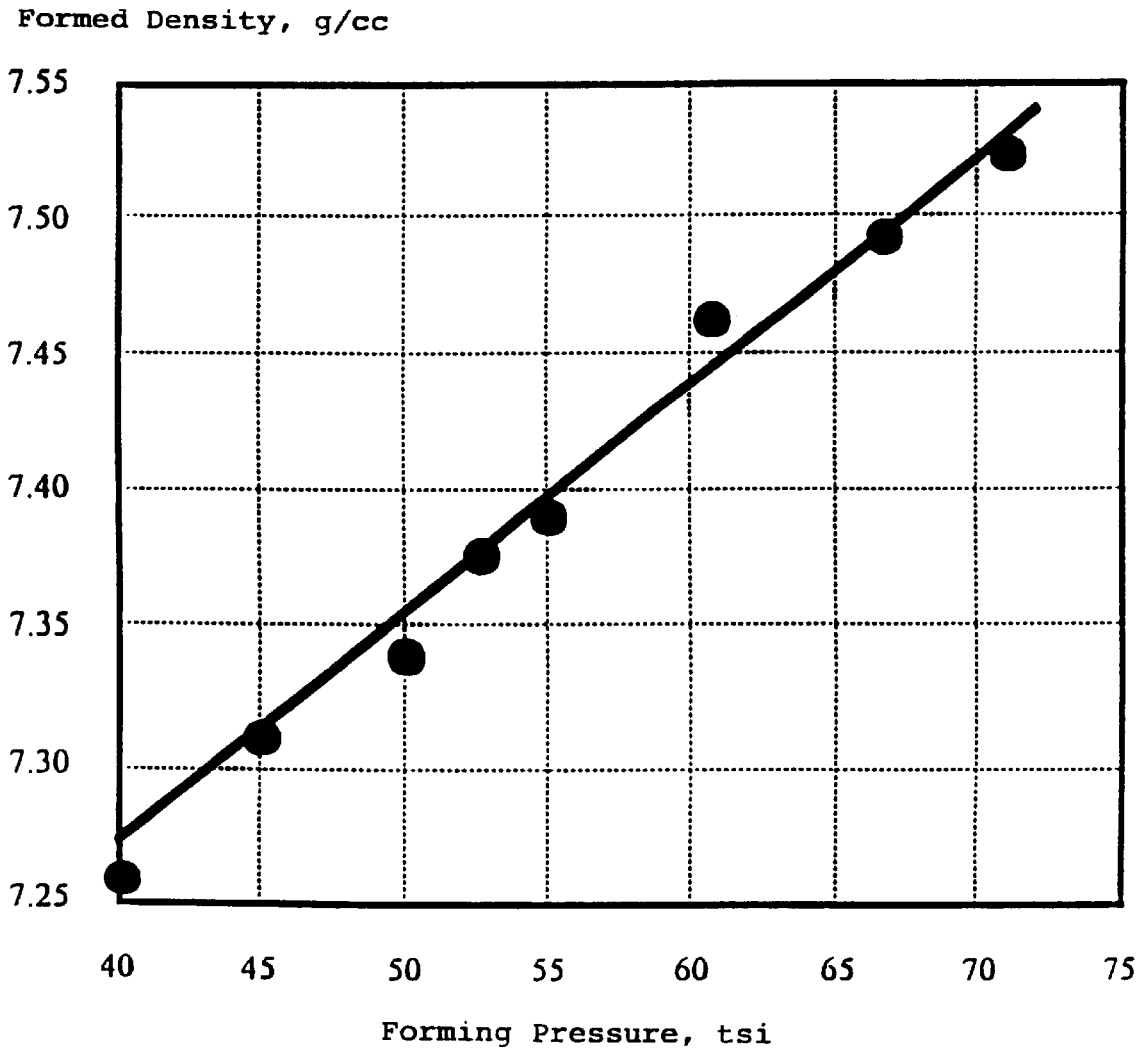
FIG. 3 is a graph of the high density forming of Fe—C—Mn test bars.

FIG. 3 shows the forming or coining of sintered powder metal test bars produced as shown in FIG. 1 having a carbon and manganese content. FIG. 3 shows that when the test bar is subject to an increase in the coining or forming pressure between 40 and 75 tons per square inch the formed sintered part will have a resultant increase in density of approximately 7.25 to just over 7.50 g/cm$^3$. In other words with an increase in forming pressure an increase in formed density occurs. The density of the Fe—C—Mn test bars will approach the theoretical density of wrought steel. In the examples outlined herein forming occurs at ambient temperature although in another embodiment forming could occur at an elevated temperature.

FIG. 4 is a chart that shows the impact of forming pressure to the formed density of a sintered part comprised of Fe—C—Mn. FIG. 4 generally illustrates that with an increase in forming pressure an increase in formed density will be observed as illustrated therein.

Figure 5:
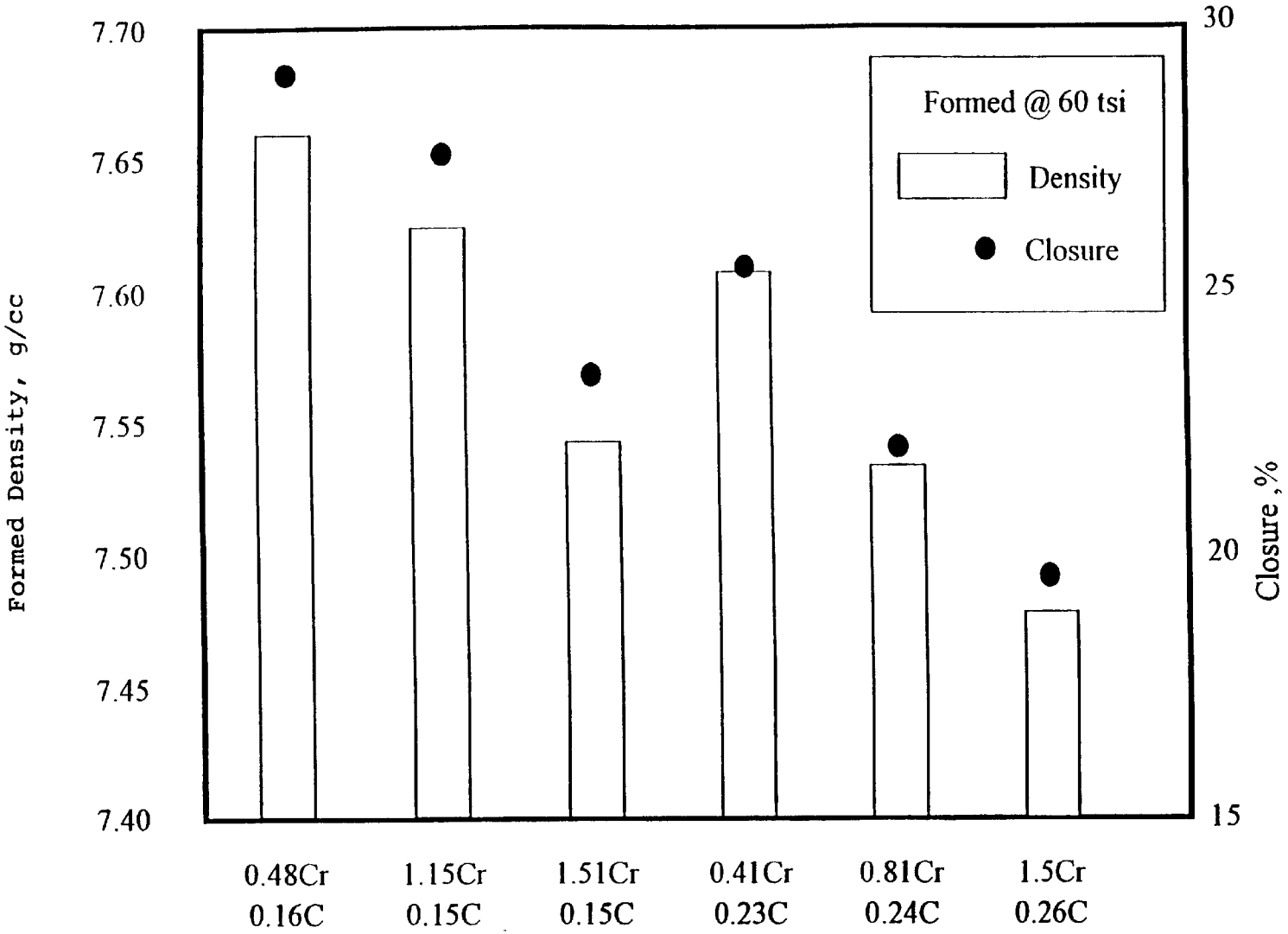
FIG. 5 is a graph of formed density and closure of Fe—C—Cr rings formed at 60 tsi.

FIG. 5 illustrates formed density and closures for Fe—C—Cr powder metal parts which are coined at 60 tons per square inch. The first bar graph to the left shows that a sintered powder metal part having 0.48% chromium and 0.16% carbon with the remainder being essentially iron and unavoidable impurities when formed or coined at 60 tons per square inch produces a formed sintered part having a density of over 7.65 g/cc. The closure or the amount of reduction S of the compressed height verses the uncompressed height of the sintered ring approaches approximately 30%. In other words, the inside diameter of the ring 21 was sufficiently large and the clearance designed so as to produce a closure or reduction of almost 30% in the compressed height verses the uncompressed height of the formed sintered ring. The second bar graph illustrates a sintered part having 1.15% chromium to 0.15% carbon to the total weight of the sintered part which is formed at 60 tons per square inch so as to produce a formed sintered part having a density of approximately 7.625 g/cc. The closure or the reduction in the height S of the same sized ring 21 is slightly lower at 28%.

The third bar graph shown in FIG. 5 shows a sintered part having 1.51% chromium and 0.15% carbon with the remainder being iron and unavoidable impurities which has been formed at 60 tons per square inch so as produce a part having a density of approximately 7.525 g/cc. The closure is approximately 25%. Three other results are also shown in FIG. 5.

Figure 6:
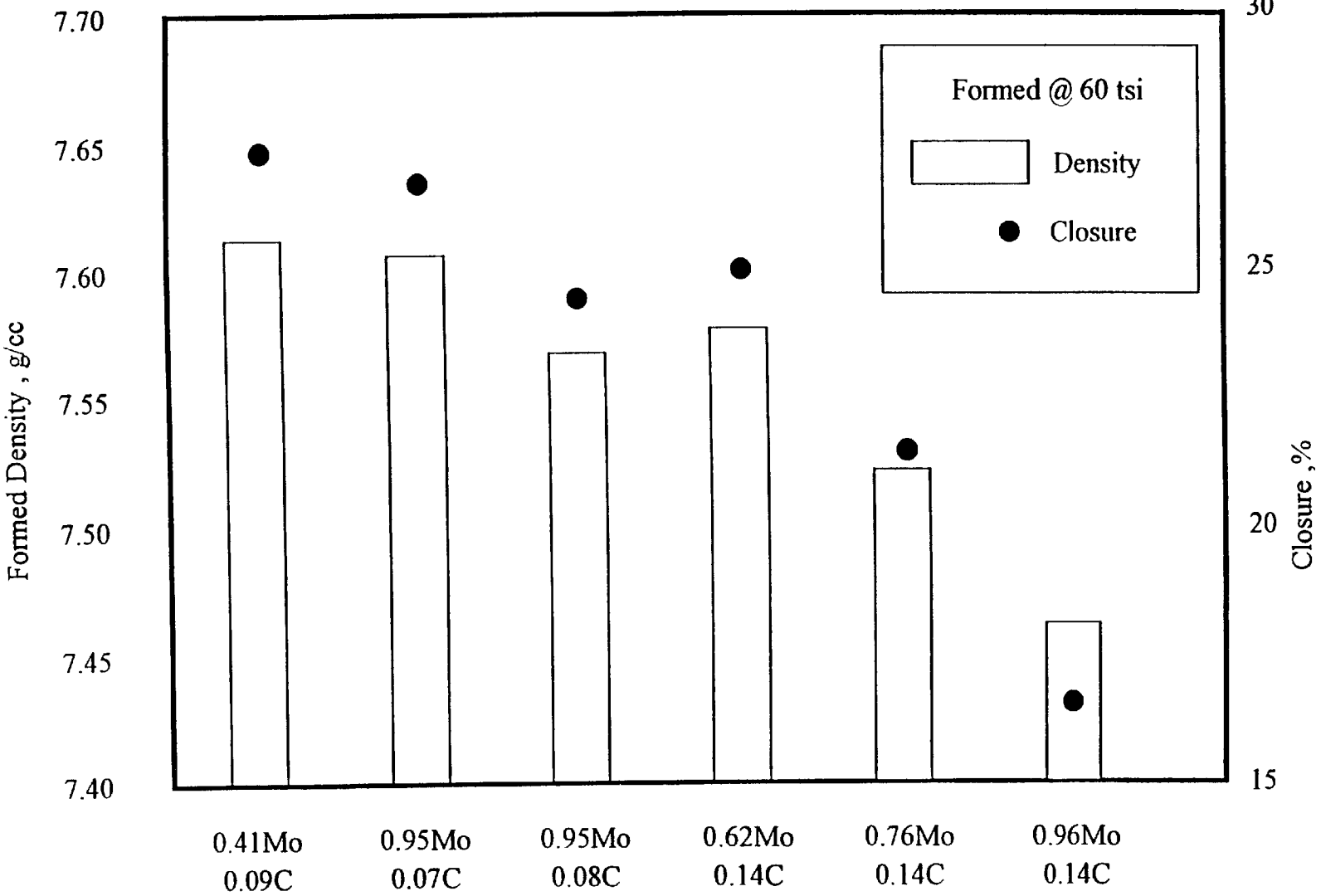
FIG. 6 is a graph of formed density and closure of Fe—C—Mo rings formed at 60 tsi.

FIG. 6 is another graph showing the formed density and closure of Fe—C—Mo powder metal which has been coined at 60 tons per square inch. Generally speaking, higher concentrations of molybdenum will decrease the density of the formed part as well as provide a smaller degree of closure. For example, a sintered part having 0.41 % by weight of molybdenum and 0.09% carbon with the remainder being iron once formed at 60 tons per square inch produces a part having a density of slightly greater than 7.60 g/cc. Closure is approximately 28%.

Figure 7:
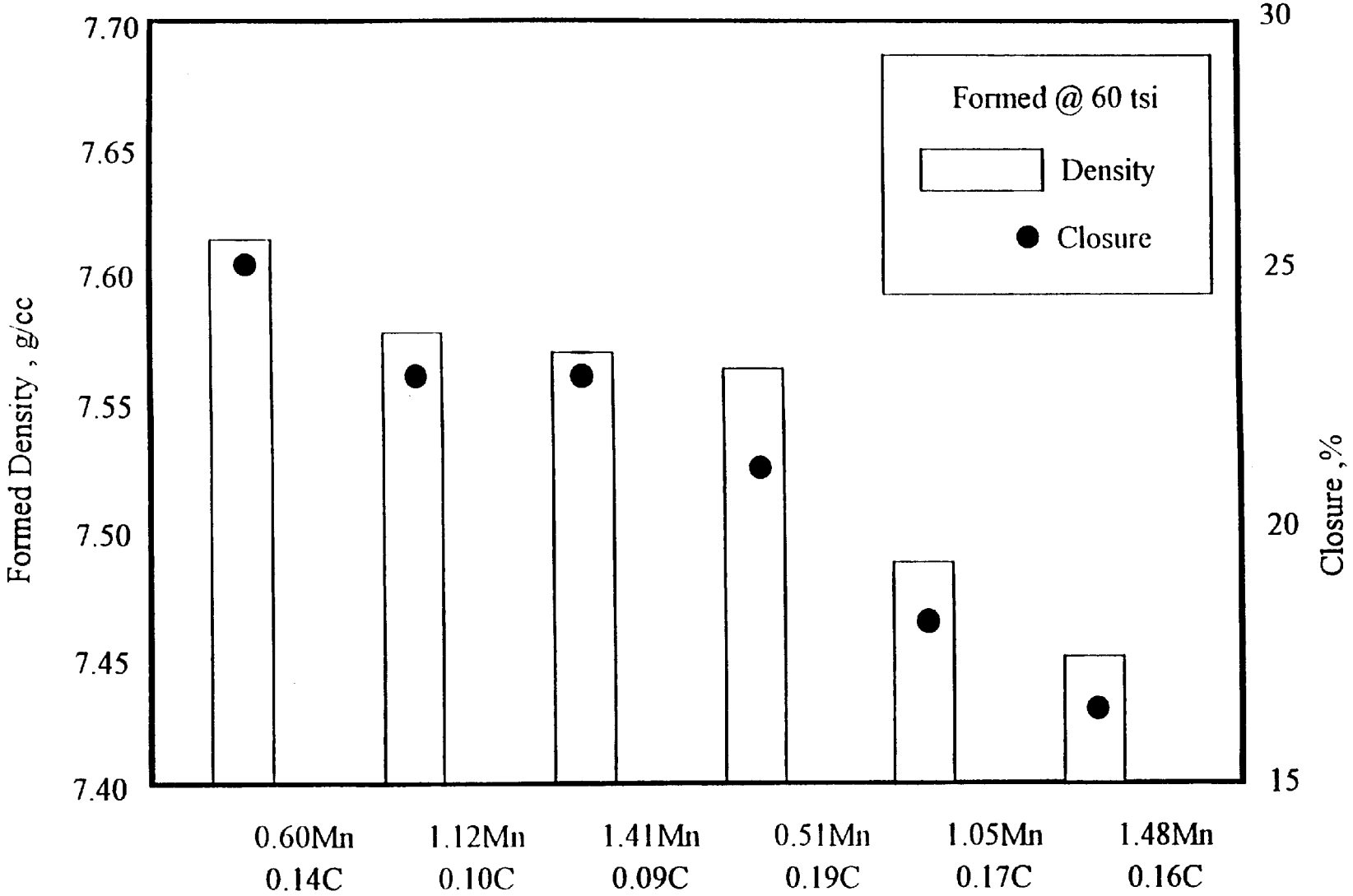
FIG. 7 is a graph of formed density and closure of Fe—C—Mn rings formed at 60 tsi.

FIG. 7 illustrates the formed density and closure Fe—C—Mn powder metal formed at 60 tons per square inch. Generally speaking higher concentrations of manganese reduce the density of the formed sintered part and permit less closure.

Figure 15:
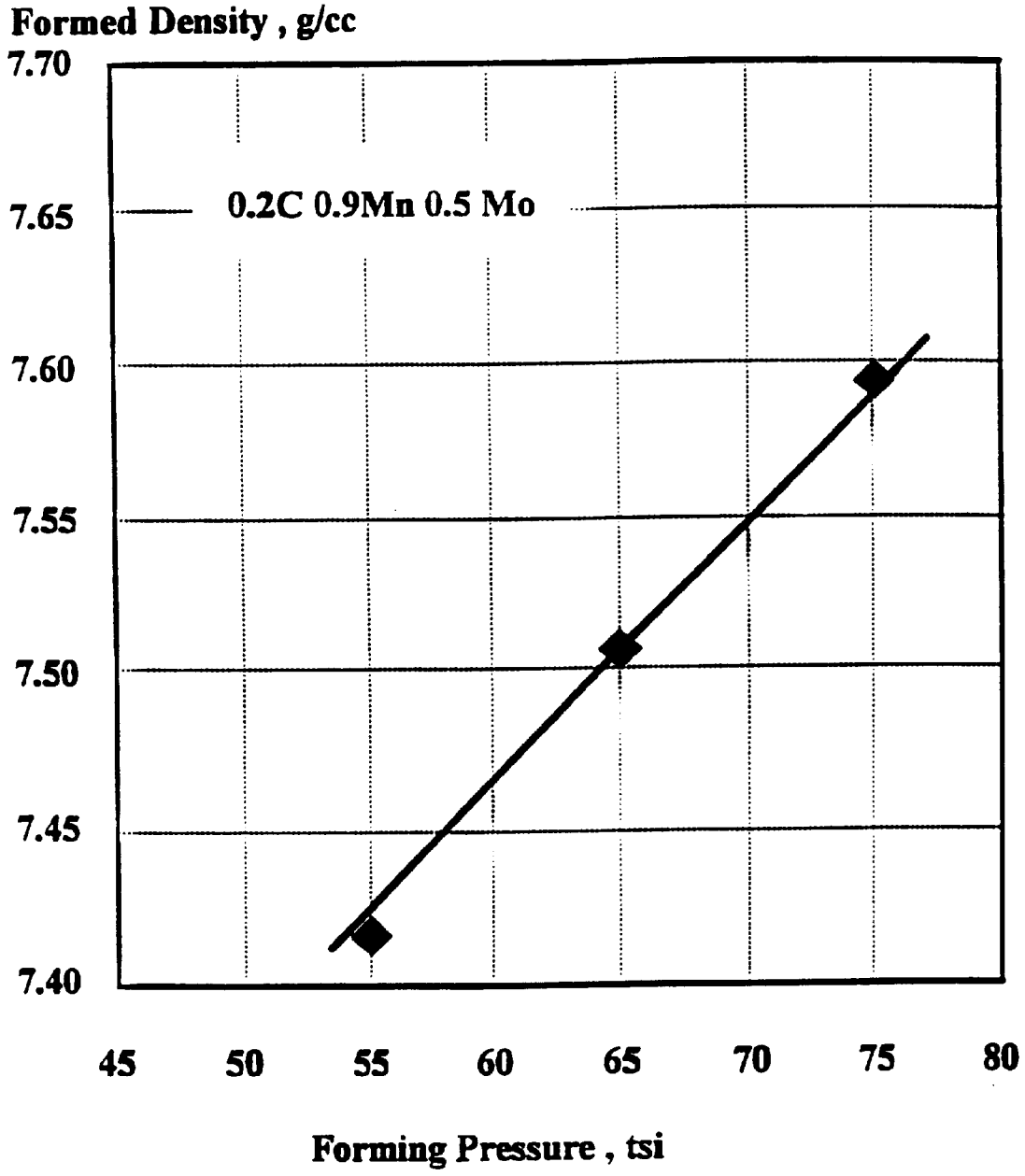
FIG. 15 is a graph showing the effect of forming pressure on density of a sintered powder metal article having 0.2% C, 0,9% Mn, 0.5% Mo with the remainder being iron and unavoidable impurities.

The foregoing shows that by controlling the chemical composition of the sintered article, and by controlling the pressing forces and clearance in a closed die cavity, a remarkable increase in density can be achieved. FIGS. 3 to 7 show the densities and closures that can be achieved when using singular combinations of the ferro alloys namely FeMo, FeCr and FMn with base iron powder. It is of course possible as described above to use more than one ferro alloy, ie FeMo, FeCr, FeMn with base iron powder as desired to achieve functional requirements of the manufactured article. For example, FIG. 15 shows that increased formed densities can be achieved with 0.2% C, 0.9% Mn and 0.5% Mo by weight. In this example FeMn and FeMo is added and blended with the base iron powder and carbon so as to produce a sintered part having 0.2% C, 0.9% Mn and 0.5% by weight to the total weight with the remainder being iron and unavoidable impurities. In other words separate ferro alloys of FeMo, FeCr and FeMn may be admixed with base iron powder.

Figure 8:
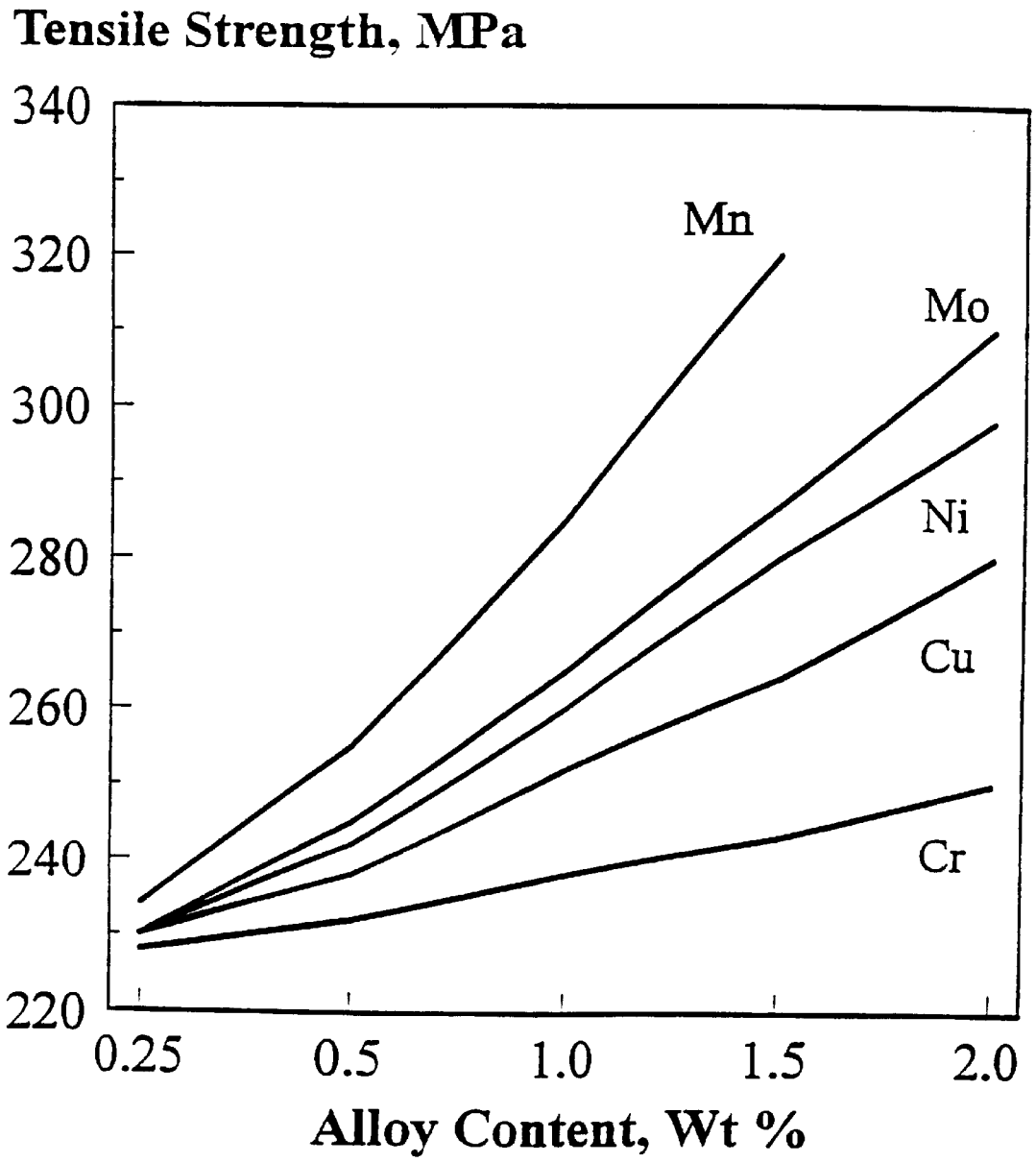
FIG. 8 is a graph of strength versus percent alloy in iron.
Figure 9:
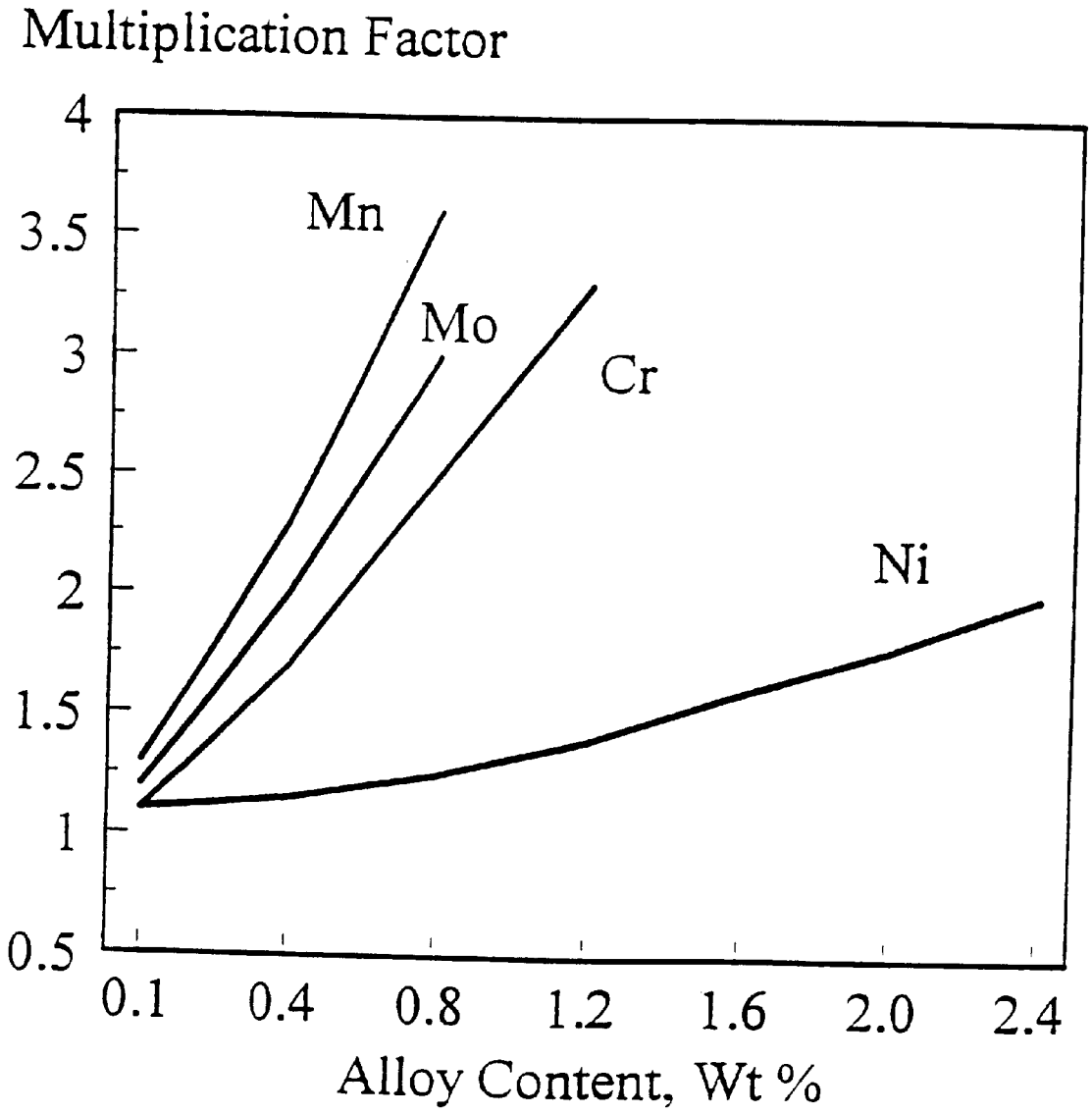
FIG. 9 is a graph of hardenability versus percent alloy in iron.

FIGS. 8 and 9 generally show the effect that the percentage of the alloyed ingredients Mn, Mo, Ni and Cr has on the strength and hardenability of the sintered part.

FIG. 8 shows that the addition of manganese has a greater effect on the tensile strength of the metal powder metal part than molybdenum, chromium or nickel.

FIG. 9 generally shows that manganese increases the hardenability of the sintered powder metal articles more than molybdenum. The addition of molybdenum has a greater effect on the hardenability of the sintered powder metal part than chromium or nickel. Furthermore one should be careful not to add a lot of manganese as this may hinder the forming operation as Mn has a strong effect on the strength. In particular no more than 1.5% of Mn should be included in the total weight of the sintered powder metal article. For example, one may use Cr since at a given composition Cr does not increase the strength of the sintered article as much as Mn (see FIG. 8) but does impart high hardenability (see FIG. 9).

Heat Treatment

Figure 10:
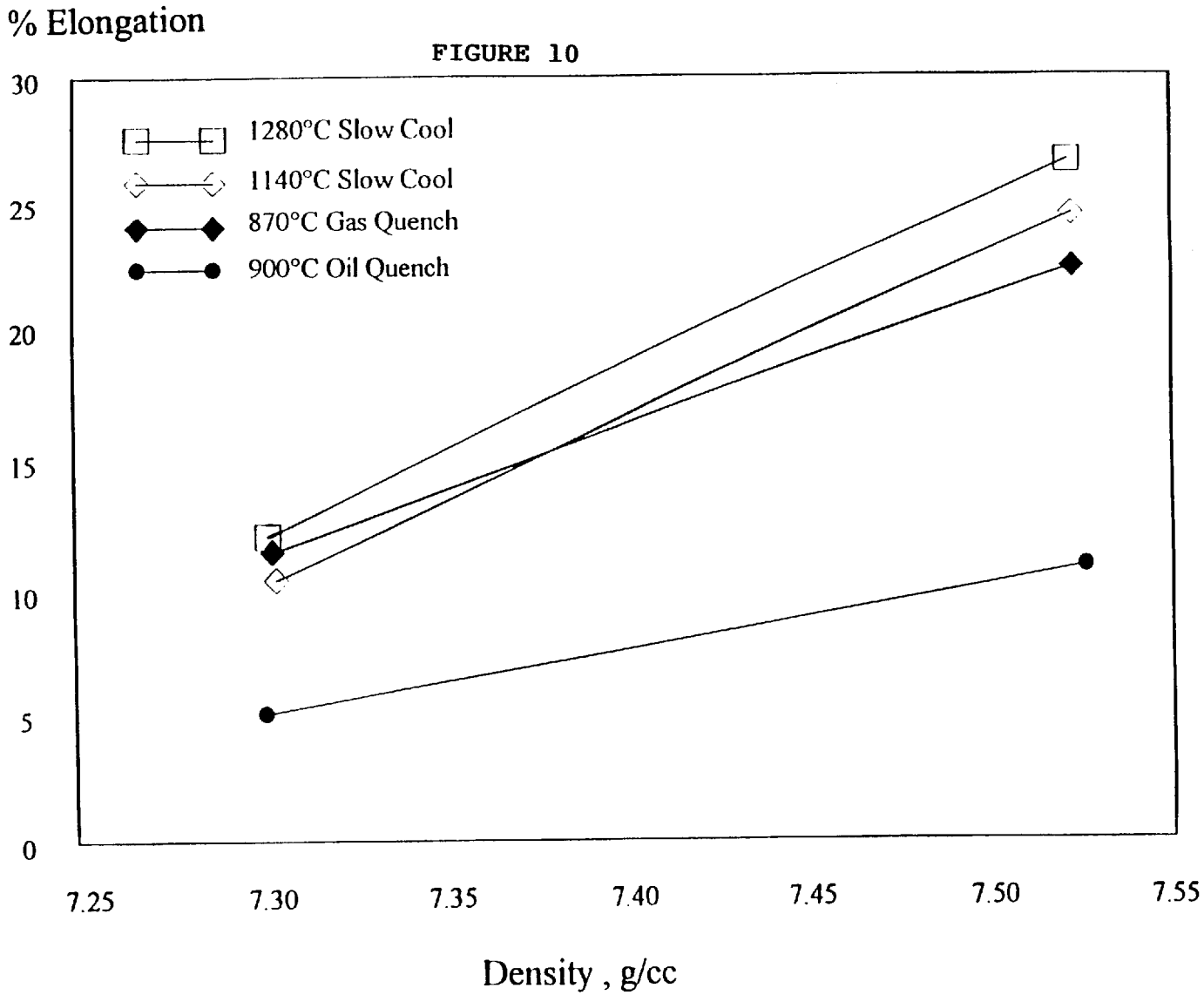
FIG. 10 is a graph of elongation of Fe—C—Mn tensile specimens with different heat treatments.
Figure 11:
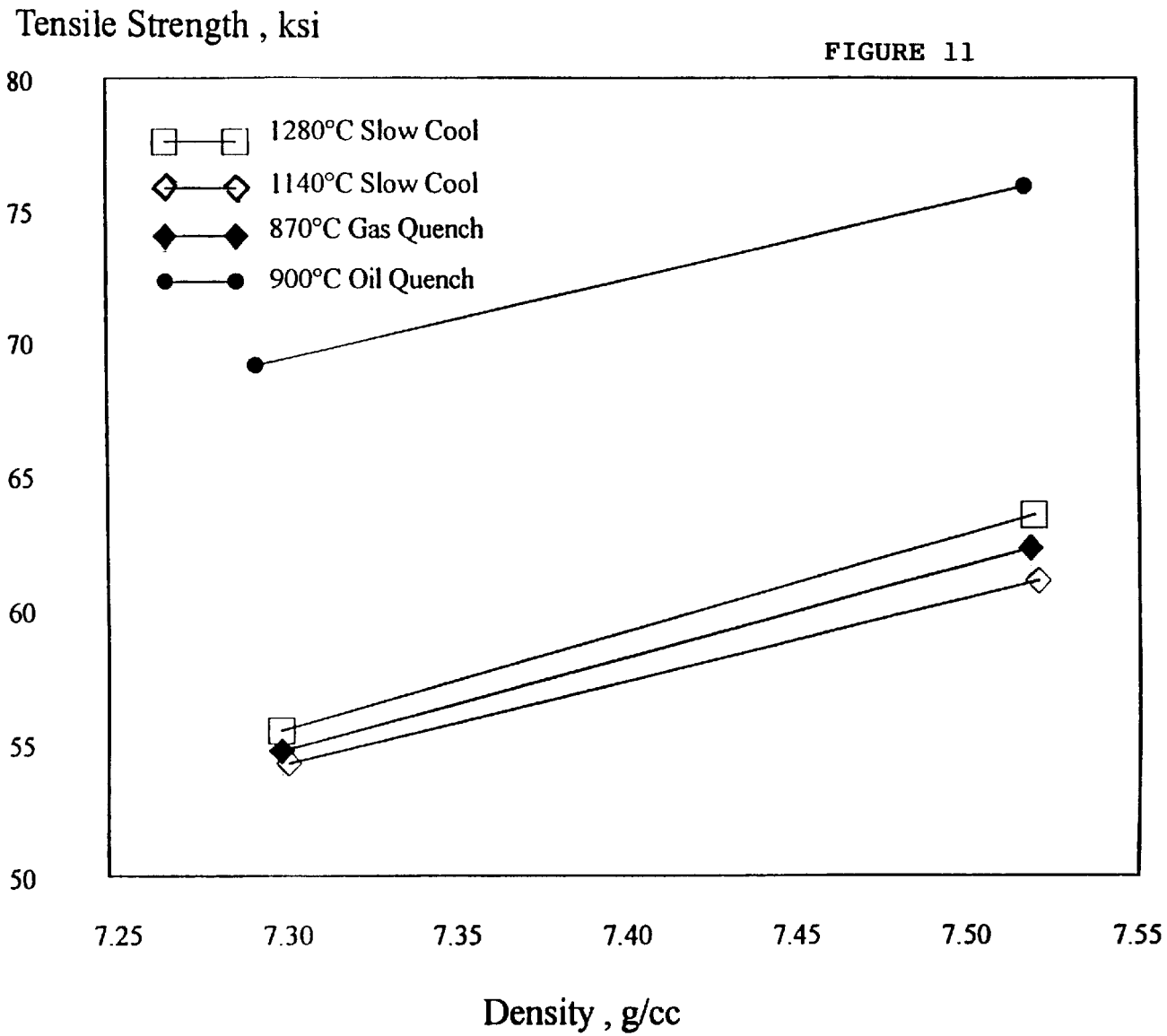
FIG. 11 is a graph of tensile strength of Fe—C—Mn specimens with different heat treatments.

Subsequent to the forming operation, in order to develop the full mechanical properties of the article, it may be necessary to subject the article to a heat treatment operation. The heat treatment operation is generally carried out within the temperature range of 800° C. to 1300° C. The attached FIGS. 10 and 11 indicate the effect of heat treatment conditions on the final mechanical properties of the article. The conditions may be varied within the above range to suit the desired functional requirements of the specific article. It is also preferable to use a protective atmosphere during the annealing process. The atmosphere prevents oxidization of the article during the exposure to the elevated temperature of the heat treatment process. The actual atmosphere used may consist of hydrogen/nitrogen blends, nitrogen/exothermic gas blends, nitrogen/endothermic gas blends, dissociated ammonia or a vacuum. In the heat treatment stage it is generally preferable to maintain a neutral atmosphere in terms of carbon potential with respect to the carbon content of the article. In special instances, for example should the article require high wear resistance, a carburizing atmosphere may be used during heat treatment. The carburizing atmosphere may consist of methane or propane where the carbon atoms will migrate from the methane or propane to the surface layers of the article. In such an operation, carbon will be introduced into the surface layers of the article. If the article is subsequently quenched, a case hardened product can be produced with beneficial wear resistant properties.

The heat treatment process specifically causes metallurgical bonding within the densified article. After forming, there is no metallurgical bonding between the compressed powder particles. Such a structure, while having high density, will generally not demonstrate good mechanical properties. At the elevated temperature of the heat treatment process, the cold worked structure will recrystallize and metallurgical bonding occurs between the compressed particles. After completion of the metallurgical bonding process, the article will demonstrate remarkable ductility properties which are unusual for sintered PM articles.

After the heat treatment, the article is ready for use and will exhibit mechanical properties that are generally very similar to wrought steel of the same chemical composition. FIG. 12 shows typical mechanical properties of a material manufactured by the invented process. The remarkable ductility, impact strength and fatigue strength to tensile strength ratio are a typical consequence of the new process. As can be seen from the comparative chart for regular PM materials (represented by the designation FC0200), which are typically manufactured to around 90% of theoretical density, the previously described mechanical properties are significantly improved. For example FIG. 12 shows the mechanical properties of a Fe C Mn (0.2C and 0.7Mn) produced by the invention described herein versus the mechanical properties of a regular PM material such as FC0200 (having a low carbon 0–0.3% C and low alloy material i.e. 1.5 to 3.9% by weight copper) versus the mechanical properties of wrought steel having the designation AISI 1020. The unnotched impact strength of Fe C Mn at greater than 120 ft lb and the elongation at 23% are notable. Fatigue properties were determined by three point bending. The high density also produces a significant improvement in elastic modulus. The elongation achieved is dependent on the alloy content and density of the final part.

If further mechanical property enhancement is required, for example in gear wheel, sprocket or bearing type applications, a selective densification process as described in U.K. patent G.B. 2,550,227B, 1994 may be utilized, which consists of densifying the outer surface of the gear teeth by a single die or twin die rolling machine and may include separate and or simultaneous root and flank rolling. In each case the rolling die is in the form of a mating gear made from hardened tool steel. In use the die is engaged with the sintered gear blank, and as the two are rotated their axis are brought together to compact and roll the selected areas of the gear blank surface.

The process as described herein can be utilized to produce a number of products including clutch backing plates, sprockets and transmission gears. Since sprockets and transmission gear generally require high wear resistance a carburizing atmosphere may be used during heat treatment. Transmission gears generally require hardened surfaces and hardened cores, and accordingly agents for increasing hardenability such as chromium or molybdenum can be added.

Alternative Method of Forming Sintered Components to High Density at Ambient Temperatures The preferred method of manufacturing a high density article as describe herein involved the use of:

(a) powder ferro alloys combined with substantially pure iron powder;

(b) prealloyed molybdenum powder metals.

It has been found that the benefits of the invention described herein may also be achieved by the use of the methods, hereinafter to be described.

In consideration to the method of selecting what alloying additions can be used, it is necessary to consider the hardenability requirements of the article that will be manufactured.

Hardenability

Hardenability is the measure of the depth to which a steel will harden on quenching. The maximum hardness is controlled by carbon content. The hardenability is a combined function of carbon content, grain size and alloy content (examples of alloying elements typically used are Mn, Cr, Mo, Ni, Cu, B, Nb, V, Si, and other typical steel alloys which may be typically used).

Significance of Hardenability

Figure 16:
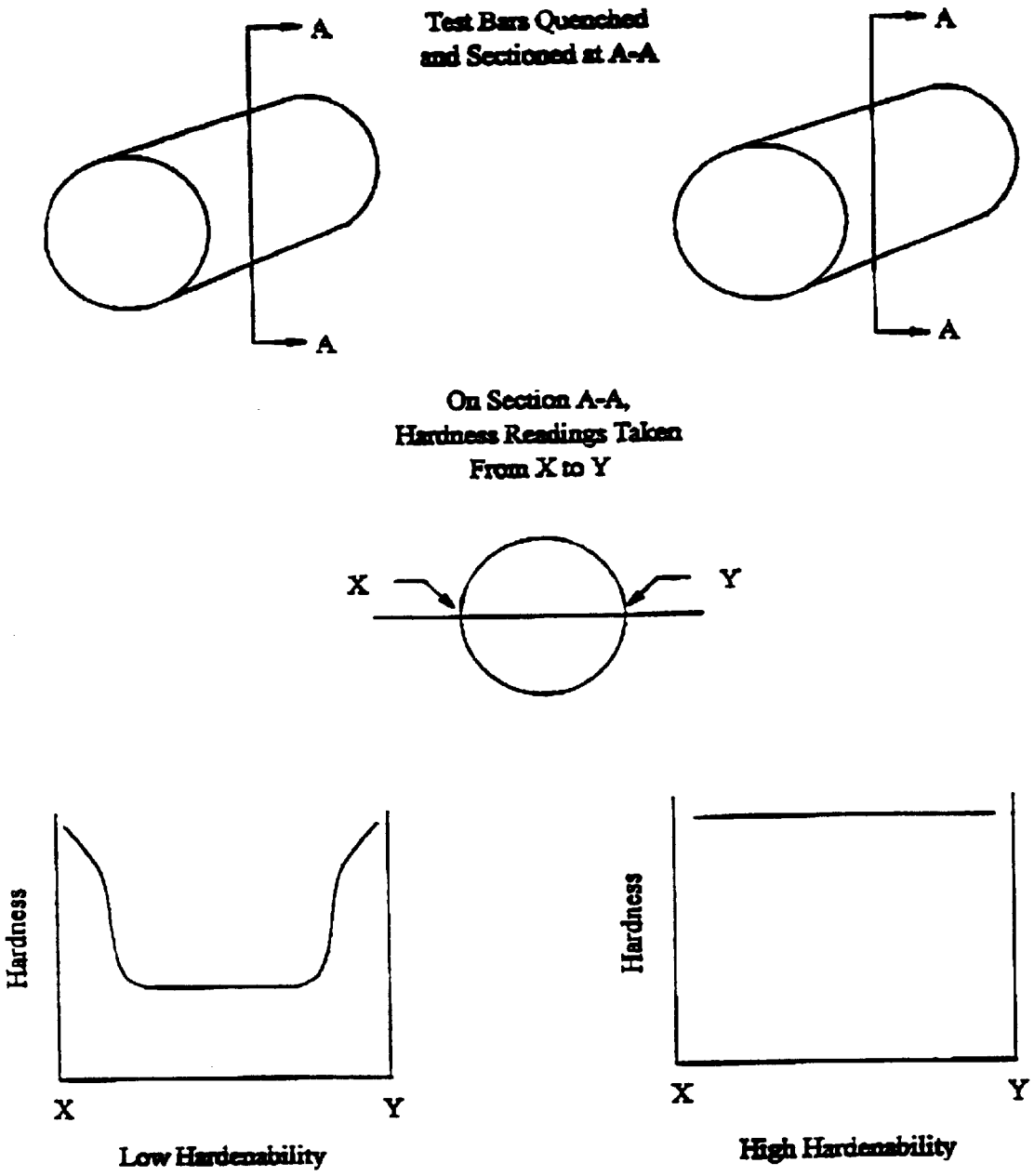
FIG. 16 illustrates steel bars having low hardenability and high hardenability.

In many engineering applications, components are heat treated by quenching and tempering in order to develop desirable mechanical properties. It is usually desirable for such components to harden in their central regions, in addition to the surface during the quenching operation. The hardness achieved in the central regions depends upon the hardenability of the material. FIG. 16 shows how hardenability influences the hardness that would be achieved after similarly quenching two pieces of steel of different hardenability. The steel with low hardenability gives low hardness in its central region after quenching. Such a condition could be undesirable for a manufactured article because low hardness leads to low strength and reduced fatigue strength of the article.

Calculation of Hardenability

The calculation of hardenability is well known in the steel processing industries. A method is based on the calculation of a certain ideal diameter (D) that will through harden on quenching. An example of an equation for calculating $D_I$ is as follows:

$$D_I = D \times F_{Mn} \times F_{Ni} \times F_{Cr} \times F_{Mo} \times F_{Cu} \text{etc}$$

where:

$D_I$ =Ideal Diameter

D=Base Diameter

F=Multiplication factor for each alloying element that is present in the steel composition.

Example

A steel contains 0.4% C, 0.8% Mn, 0.2% Si, 1.8% Ni, 0.9% Cr and 0.30% Mo. It has a grain size of 7 (7 refers to a comparison chart available in the trade). First the base diameter is determined from the chart of FIG. 17 from the known carbon content of 0.4% and the grain size of 7. The base diameter, D, is found to be 0.213 inches.

Figure 18:
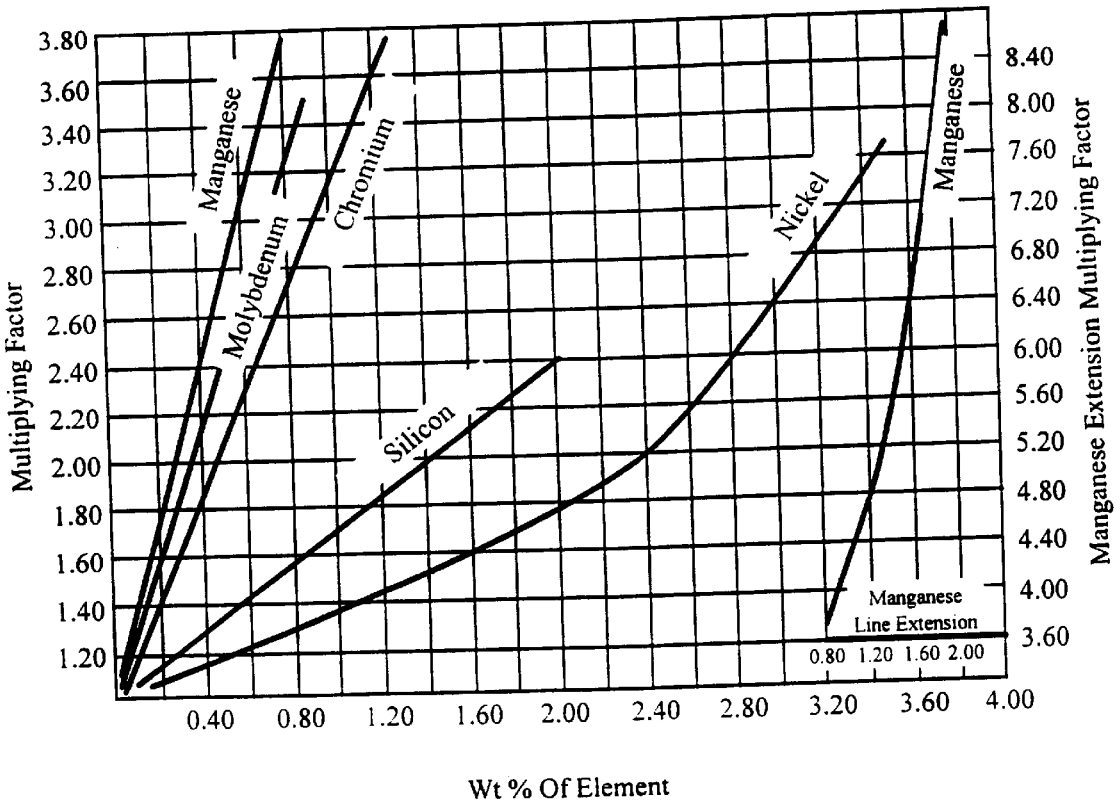
FIG. 18 is a chart illustrating hardenability multiplying factor.

Next the multiplication factors for each alloying element are found from the chart of FIG. 18. This gives $F_{Mn}$=3.667, $F_{Si}$=1.14, $F_{Ni}$=1.68, $F_{Cr}$=2.944, $F_{Mo}$=1.9.

Applying these values to the equation gives the following:

$$D_I = 0.213 \times 3.667 \times 1.14 \times 1.68 \times 2.944 \times 1.9 = 8.367 \text{ inches.}$$

Thus on quenching the above steel in the form of a round bar, through hardening would be expected up to a diameter of 8.367 inches. At larger diameters the centre of the bar would not be fully hardened.

Alternatively, if the manufactured article has a section of less than 8.367 inches, then reduced levels of alloying elements could be used to reduce cost.

Relation of Hardenability to the Invention

The above example shows that a certain desired hardenability could be achieved with a great number of alloying element combinations and addition levels. The preferred method of manufacturing a high density article as described herein is to use powder ferro alloys combined with relatively pure iron powder. However, numerous other powders may be cited for use in achieving useful and desirable hardenability of the final article. For example, powders from the following groups, either individually or in combination with each other could be used:

1. elemental or substantially pure powder blends (i.e. having only trace elements or unavoidable impurities say for example less than 1% by weight which are available in the market place)
2. fully prealloyed powder blends
3. partially prealloyed powder blends
4. powder blends containing ferro alloys.

Example

FIG. 15 illustrates the effect of forming pressure on density of a 0.2C, 0.9Mn, 0.5Mo material which was produced through the use of powder ferro alloys combined with substantially pure iron powder. This formed sintered compact exhibited a density between 7.4 and 7.7 g/cc and had a compressed length which was approximately 3 to 30% less than its original length when formed in a closed die cavity having a clearance.

Although the formed sintered part having 0.2C, 0.9Mn and 0.5Mo was produced with substantially pure iron powder and ferro alloys one can achieve the same result by utilizing other powders, as referred to in items 1, 2, 3, 4, above. For example, prealloyed powders such as Atomet 4601 available from QMP having the following characteristics could be used:

| | |
|---|---|
| Apparent density g/cm$^3$ | 2.92 |
| Flow rate sec/50 g | 26 |
| Chemical Analysis: | |
| Iron content | 97%+ |
| Carbon | 0.003% |
| Oxygen | 0.10% |
| Sulphur | 0.009% |
| Phosphorous | 0.012% |
| Silicon | 0.003% |
| Manganese | 0.20% |
| Nickel | 1.8% |
| Molybdenum | 0.55% |
| Screen Analysis: | |
| US mesh | trace |
| +70 | 10 |
| 70/100 | 17 |
| 100/140 | 20 |
| 140/200 | 25 |
| 200/325 | 28 |

In order to determine if one can use Atomet 4601 in place of the substantially pure iron powder and ferro alloys, one must determine the critical diameter for the 0.2C, 0.9Mn, 0.5Mo material referred to in FIG. 15, which for example would have a grain size of 7.

Figure 17:
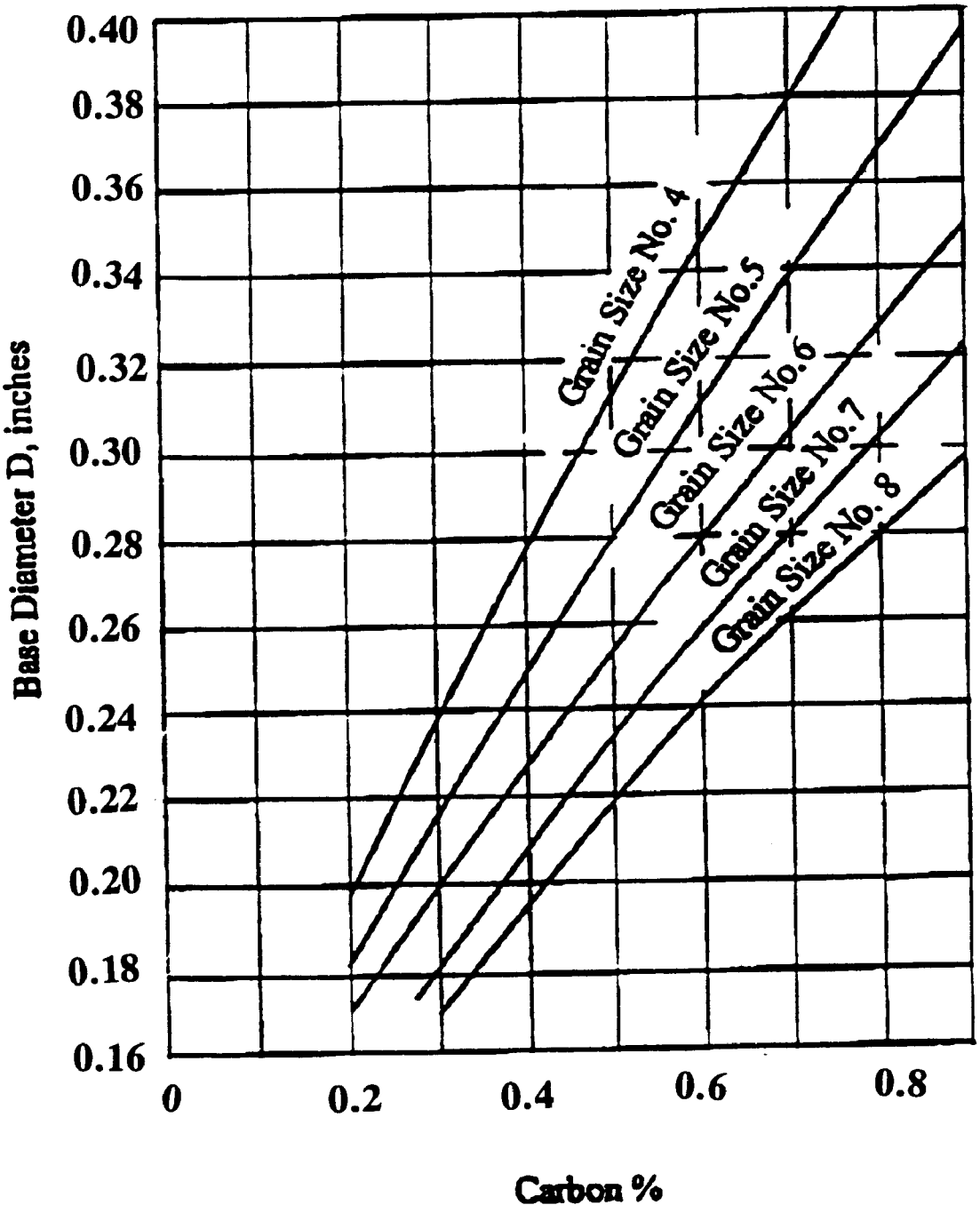
FIG. 17 is a chart illustrating the relationship between base diameter and carbon composition.

D=0.15 (extrapolated from FIG. 17 with grain size 7, carbon 0.2)

$F_{Mn}$=4.2 (from FIG. 18)

$F_{Mo}$=2.5 (extrapolated from FIG. 18)

$D_I = D \times F_{Mn} \times F_{Mo}$
$= 0.15 \times 4.2 \times 2.5$
$= 1.58$ inches Thus on quenching the above steel in the form of a round bar, through hardening would be expected up to a diameter of 1.58 inches. When formed in a closed die cavity such material (i.e. 0.2C, 0.9Mn, 0.5Mo) would have a density between 7.4 to 7.7 g/cc (depending on the forming pressure and a closure for movement of the formed sintered powder metal part having a compressed length which is approximately 3 to 30% less than the original length) .

One could achieve substantially similar results with other material such as Atomet 4601 particularized above i.e.

C=0.003

Si=0.003

Mn=0.2

Ni=1.8

Mo=0.55 with for example a grain size of 7 and adding carbon in the form of graphite so as to produce a sintered part having a total carbon content of 0.2% C.

In this case:

D=0.15 (with 0.2% C, grain size 7 from FIG. 17)

$F_{Si}$-negligible (i.e. approximately 1 from FIG. 18)

$F_{Mn}$-1.75 (FIG. 18)

$F_{Ni}$-1.7 (FIG. 18)

$F_{Mo}$-2.6 (extrapolated from FIG. 18)

$D_I = D \times F_{Si} \times F_{Mn} \times F_{Ni} \times F_{Mo}$
$= 0.15 \times 1.75 \times 1.7 \times 2.6$
$= 1.16$ Accordingly, from the point of hardenability if one used Atomet 4601 prealloy as the starting material, on quenching the sintered formed powder metal part through hardening would be expected up to a diameter of 1.16 inches. This is not quite equivalent to the hardenability of 0.2C, 0.9Mn, 0.5Mo composition referred to in FIG. 15 which means that if a sintered part such as a gear having a section of less than 1.16 inches was required the Atomet 4601 prealloy could be used in place of the substantially pure iron powder with ferro alloys to produce through hardening on quenching that would match the 0.2C, 0.9Mn, 0.5Mo composition. Alternatively if a diameter of 1.58 inches was required for a sintered part such as a gear one could use Atomet 4601 prealloy and obtain substantially similar hardenability to the 0.2C, 0.9Mn, 0.5Mo ferro alloy composition of FIG. 15 by adding another alloying element to increase $D_I$ to 1.58 from 1.16 inches.

required critical diameter=1.58 actual diameter=1.16 multiplication factor required=x
$1.58 = 1.43 \times$
$= 1.36$

In other words one must add an alloying element which has the effect of increasing the multiplication factor by 1.36.

For example, by referring to FIG. 18 one could increase the hardenability of the Atomet 4601 by a factor of 1.36 if:

(a) 0.25Cr is added either as a substantially pure powder ferro alloy or as a prealloy so long as the other multiplication factors were not affected; or (b) add another alloying element such as manganese or Ni or Mo again either in the form of a substantially pure powder, ferro alloy, or prealloy so long as the other multiplication factors were not affected.

For example from FIG. 18:

| | Factor from Atomet 4601 | Target factor to be increased by 1.36 | Required % of element from FIG. 18 | % of Element from Atomet 4601 | Addition of alloying element |
|---|---|---|---|---|---|
| $F_{Mn}$ | 1.75 | 1.75 × 1.36 = 2.38 | 0.40% | 0.2 | 0.20 |
| $F_{Ni}$ | 1.7 | 1.7 × 1.36 = 2.31 | 2.80% | 1.9 | 0.90 |
| $F_{Mo}$ | 2.6 | 2.6 × 1.36 = 3.53 | 0.84% | 0.55 | 0.29 |

Therefore one could add to the Atomet 4601 either:

0.20% Mn or 0.90% Ni or 0.29% Mo by weight either as substantially pure powder or ferro alloy or prealloy so long as the other multiplication factors were not changed or effected in which case the hardenability would be substantially the same as the 0.2C, 0.9Mn, 0.5Mo composition i.e. critical diameter being 1.58 inches. Alternatively if the 4601 prealloy would be used in place of the 0.2C, 0.9Mn, 0.5Mo ferro alloy composition in a sintered part having a section of 1.16 inches or less the through hardness upon quenching of the two materials would be substantially the same. In this situation, the ferro alloy content would be adjusted, to reduce either Mn or Mo content to give a $D_I$ of 1.16 inches so as to reduce costs.

In order to produce a PM part, the powder would be compacted as described and then sintered. Sintering of the prealloys and elemental blends could occur at a temperature of 1100° C. or above.

Similar calculations could be used for an endless array of powder compositions. The target of such calculations is to arrive at a critical diameter similar to that achieved when using substantially pure iron powder with ferro alloys and which upon the application of the forming step produces a sintered part having a density of 7.4 to 7.7 g/cc.

Therefore a further step in the alternative procedure involves not only considering the hardenability but achieving the desired density of 7.4 to 7.7 g/cc upon forming.

If one looks to the above example one could add to the Atomet 4601

0.20% Mn or 0.90% Ni or 0.29% Mo as described so as to arrive at the critical diameter of 1.58 which is similar to the 0.2C, 0.9Mn, 0.5Mo composition. However, by referring to FIG. 18 Mn has a greater effect on the strengthening of steel than Ni. In order to determine whether the sintered powder metal part will produce a density of between 7.4 to 7.7 g/cc when formed, test bars are produced and subject to an increase in the coining or forming pressure between 40 to 75 tons per square inch as described above. The formed test bars are then tested for the density to empirically determine whether the formed sintered part has a density between 7.4 to 7.7 g/cc. For example, it may be empirically determined that if 0.20% Mn is added to the Atomet 4601 prealloyed powder for a total .40% Mn that the strength of the sintered part is too great (see FIG. 8) to produce a formed sintered part having a density between 7.4 to 7.7 g/cc.

Alternatively, instead of adding either 0.20% Mn or 0.90% Ni or 0.29% Mo one may decide to add Cr. FIG. 18 shows that Cr has a relatively large multiplication factor to hardenability vis-a-vis Mn, yet Cr has much less effect on the tensile strength of steel than Mn as illustrated in FIG. 8.

Therefore in order to increase the hardenability of Atomet 4601 to 1.58 a sufficient amount of Cr in the form of a prealloy, ferro alloy or substantially pure powder may be added, to increase the multiplication factor by 1.36. By referring to FIG. 18 0.18% of Cr would be added to the Atomet 4601 prealloy . Test bars could be produced and subjected to the forming pressure in the closed die with the closure as described and tested to determine if the density falls within the range of 7.4 to 7.7 g/cc.

Other compositions could be tested in accordance with the teaching described herein to empirically determine which combinations of powder would produce densities between 7.4 to 7.7 g/cc and whether the formed sintered powder metal part has a compressed length which is approximately 3 to 30% less than the original length.

In the application described herein, high density formed sintered products are produced through the use of:

(a) substantially pure iron powder with the addition of ferro alloys, or (b) a prealloyed molybdenum powder The use of the substantially pure iron powder admixed with ferro alloys is preferred as such powders are relatively highly compressible, relatively inexpensive vis-a-vis prealloys and are easily tailored in view of the fact that separate ferro alloy elements can be added. However, the results of the invention described herein can also be achieved as described through the use of the molybdenum prealloyed powders. As a further alternative, other powder blends may be used as described. In order to determine what other powder blends may be used the following steps are required:

1. selecting a target critical diameter so as to achieve through hardening upon quenching of the formed sintered part, and
2. selecting a powder composition which achieves the selected target critical diameter; and
3. empirically determining that the sintered part comprised of the selected composition results in a formed sintered product which exhibits density between 7.4 and 7.7 g/cc.

In all aspects of the invention described herein whether using the preferred ferro alloys, or prealloys, or other blends described herein forming to high density is accomplished by:

(i) selecting the composition of the sintered compact;

(ii) selecting the pressure used in the forming operation;

(iii) selecting the forming tool so as to provide clearance in tools for movement of the sintered compact to final shape.

By controlling the chemical composition of the sintered article and by controlling the pressure forces and clearance in a closed die cavity a remarkable increase in the density can be achieved.

Although the example used in the further alternate method herein described was in relation to Atomet 4601 other prealloyed powders which are generally available can also be used such as for example Atomet 4201 which generally includes an iron content of 98%+, Carbon 0.04%, Manganese 0.8%, Nickel 0.45%, and Molybdenum at 0.6%. Other prealloys however can be used in accordance with the teachings of this invention.

Moreover, alloying with more conventional powders such as nickel, and copper could also be used.

Figure 19:
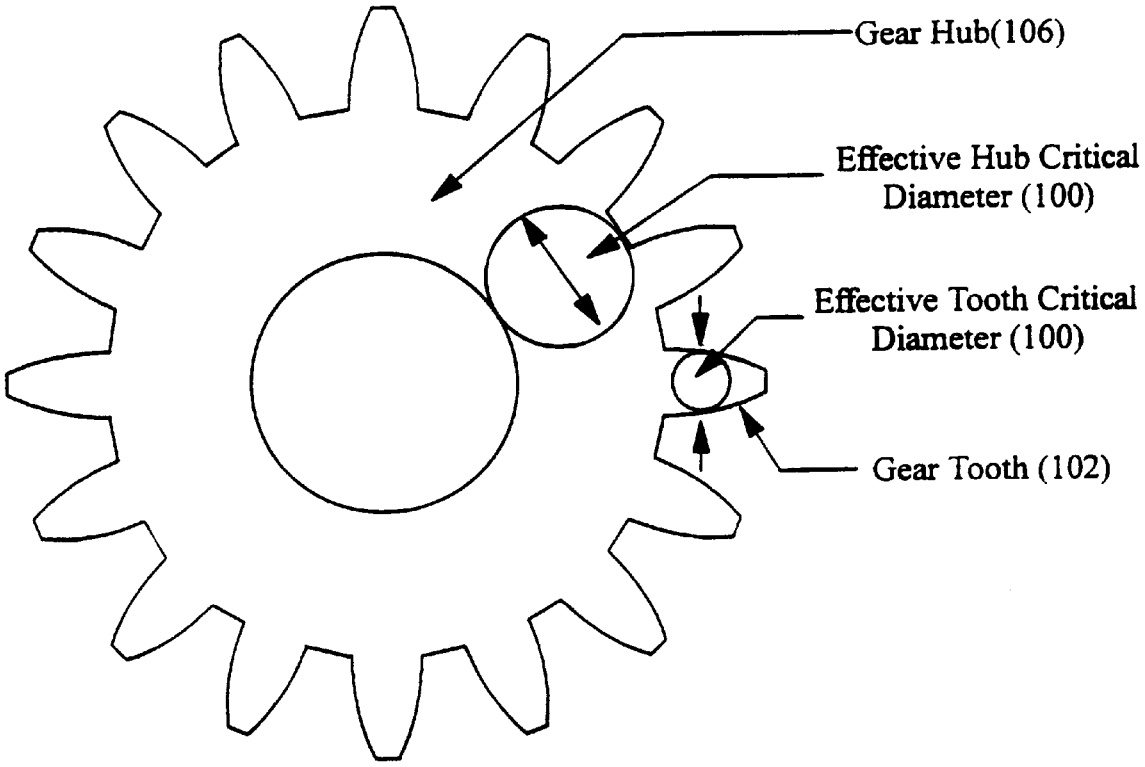
FIG. 19 is a view of a transmission gear.

Moreover, the various methods described herein can be utilized to produce gears such as transmission gears having a high density. In particular, when utilizing the further alternate method described herein to produce gears such as transmission gears having high density the reference to critical diameter relates to the effective critical diameter or critical sections of the gear. For example, the effective critical section or critical diameter of 100 or of a tooth 102 is illustrated in FIG. 19. Similarly the effective critical diameter or critical section 104 of hub 106 is illustrated in FIG. 19. Accordingly one can produce gears such as transmission gears having the requisite density of 7.4 to 7.7 g/cc in the various critical sections 100 and 104 by selecting the composition or pressure and forming tools to produce densities between 7.4 and 7.7 g/cc.

One may use the alternate method involving the calculation of critical diameter or sections to design gears have densities of 7.4 to 7.7 g/cc. Such method would involve the determination of the critical sections 100 and 104 in the various portions of the gear. The target critical section diameter could be designed to through harden the thickest section of the gear since as a consequence the thinner sections would be through hardened as well. One could then design the gear with a particular carbon content such as 0.2% for example and select the grain size of 7. Alternatively, one may wish to design a powder metal gear which has good strength characteristics vis-a-vis a gear made in a traditional manner from wrought steel having 8620 AISI designation. For example, the 8620 AISI designation has an approximate content of:

(a) Ni 0.55%

(b) Cr 0.50%

(c) Mo 0.2%

(d) Mn 0.8%

(e) C 0.2%.

Thereafter one would select the various powders as described above and determine the critical sections as described in order to achieve the target critical sections. Thereafter various test bars of the formed sintered part would be produced and analyzed to determine densities. Thereafter those powder compositions are selected to produce products and parts such as gears which exhibit the required density of 7.4 to 7.7 g/cc in the critical sections.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A method of forming sintered powder metal articles to a high density by:

(a) selecting a target critical diameter so as to achieve through hardening upon quenching of the formed sintered part;

(b) selecting a powder composition which achieves the selected target critical diameter and which allows forming to a high density of between 7.4 and 7.7 g/cc.

2. A method as claimed in claim 1 wherein said powder composition is selected from:

(a) substantially pure powder blends;

(b) fully prealloyed powder blends;

(c) partially prealloyed powder blends;

(d) powder blends containing ferro alloys.

3. A method as claimed in claim 2 wherein said powders comprise fully prealloyed powders.

4. A method as claimed in claim 2 wherein said alloying elements comprise base iron powder with ferro alloys.

5. A method as claimed in claim 4 wherein said sintered powder metal is formed in a closed die cavity having clearance for movement of said sintered powder metal to final shape with increased density after compression wherein the formed sintered powder metal part has a compressed length which is approximately 3 to 30% less than the original length.

6. A method of forming sintered powder metal articles by:

(a) selecting a target critical diameter so as to achieve through hardening upon quenching of the formed sintered article;

(b) selecting a powder composition which achieves the selected target critical diameter;

(c) blending said powder composition;

(d) pressing said blended mixture to form said article;

(e) sintering said compact at a temperature of at least 1100° C.;

(f) forming said sintered article in a closed die cavity having a clearance so as to produce a formed sintered powder metal part having a compressed length which is approximately 3 to 19% less than the original length when subjected to a pressure between 40 and 90 tonnes per square inch so as to increase the density of said formed sintered article.

7. A method as claimed in claim 6 wherein said powder composition is selected from:

(a) elemental or substantially pure powder blends;

(b) fully prealloyed powder blends;

(c) partially prealloyed powder blends;

(d) powder blends containing ferro alloys.

8. A method as claimed in claim 7 wherein said powder blends containing ferro alloys comprise substantially pure iron powder and at least one ferro alloy selected from the group of ferro molybedum, ferro chromium, ferro magnesium.

9. A method as claimed in claim 8 wherein said blended powder metal is pressed to approximately 90% of theoretical density.

10. A method as claimed in claim 9 wherein said sintered powder metal is formed to a density of at least 94% of theoretical density.

11. A method as claimed in claim 10 wherein said formed sintered powder metal has a density between 7.4 and 7.7 g/cc.

12. A method as claimed in claim 11 wherein said formed sintered article is annealed at a temperature greater than 800° C. in a reducing or carburizing atmosphere or vacuum.

13. A method of forming sintered powder metal articles by forming the sintered powder metal in a closed die cavity having a clearance for movement of said sintered powder metal to final shape with density between 7.4 and 7.7 g/cc, said powder metal part having a compressed length which is approximately 3 to 30% less than the original length.

14. A method as claimed in claim 1 wherein the article has the surface density increased by selective densification.

15. A method as claimed in claim 14 wherein said article is subjected to heat treatment process to develop selected mechanical properties.

16. A method of producing a sintered powder metal article comprising:

(a) selecting a target critical diameter so as to achieve through hardening upon quenching of the formed sintered article;

(b) selecting:

(i) a powder composition so as to achieve said selected critical target diameter;

(ii) a pressure to form said sintered powder metal article at a density of 7.4 to 7.7 g/cc;

(iii) a forming tool so as to provide a clearance in said tool for movement of said formed sintered article to final shape with increased density to said 7.4 to 7.7 g/cc.

17. A method as claimed in claim 16 wherein said target critical diameter is determined by:

$$D_1 = D \times F_1 \times F_2 \ldots \times F_n$$

where:

$D_1$=target critical diameter

D=base diameter $F_1$, $F_2$, $F_n$=multiplication factor for each alloying element that is present in said powder metal composition.

18. A method as claimed in claim 16 wherein said powder metal composition comprises:

(a) blending iron based powder with ferro alloys, graphite and lubricant to provide a selected chemical composition for said sintered powder metal article having by weight percent:

0 to 0.5% carbon 0 to 1.5% manganese 0 to 1.5% molybdenum 0 to 1.5% chromium with the remainder being iron and unavoidable impurities.

19. A method as claimed in claim 16 wherein said powder metal composition comprises:

(a) blending carbon and lubricant with a prealloyed molybdenum powder to provide a selected chemical composition for said sintered powder metal having by weight percent:

0.5 to 1.7% molybdenum with the remainder being iron and unavoidable impurities.

20. A method as claimed in claim 18 wherein said total alloy composition comprises up to 4.0% of the total weight of said sintered article.

* * * * *

UNITED STATES PATENT AND TRADEMARK OFFICE

CERTIFICATE OF CORRECTION

PATENT NO. : 6,143,240
DATED : November 7, 2000
INVENTOR(S) : Jones, Peter and Lawcock, Roger It is certified that error appears in the above-identified patent and that said Letters Patent is hereby corrected as shown below:

Column 20,
Lines 43 and 44, replace “magnesium” with -- manganese --.

Signed and Sealed this

Eleventh Day of October, 2005

JON W. DUDAS
*Director of the United States Patent and Trademark Office*